US010011408B2

(12) United States Patent
Pucci

(10) Patent No.: US 10,011,408 B2
(45) Date of Patent: Jul. 3, 2018

(54) SAFETY CAPSULE FOR CONTAINERS

(71) Applicant: SACMI COOPERATIVA MECCANICI IMOLA SOCIETA' COOPERATIVA, Imola (BO) (IT)

(72) Inventor: Fabrizio Pucci, Castel Guelfo di Bologna (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 90 days.

(21) Appl. No.: 14/905,937

(22) PCT Filed: Aug. 28, 2014

(86) PCT No.: PCT/IB2014/064107
§ 371 (c)(1),
(2) Date: Jan. 18, 2016

(87) PCT Pub. No.: WO2015/028959
PCT Pub. Date: Mar. 5, 2015

(65) Prior Publication Data

US 2016/0159537 A1 Jun. 9, 2016

(30) Foreign Application Priority Data

Aug. 29, 2013 (IT) ..... MO2013A0242

(51) Int. Cl.
*B65D 55/02* (2006.01)
*B65D 41/34* (2006.01)
*B65D 41/04* (2006.01)

(52) U.S. Cl.
CPC ..... *B65D 55/026* (2013.01); *B65D 41/045* (2013.01); *B65D 55/022* (2013.01); *B65D 2101/0069* (2013.01)

(58) Field of Classification Search
CPC .. B65D 55/026; B65D 55/022; B65D 41/045; B65D 2101/0069; B65D 50/041;
(Continued)

(56) References Cited

U.S. PATENT DOCUMENTS 2,201,205 A * 5/1940 Samburg ..... B65D 55/026 215/230
2,201,791 A * 5/1940 Samburg ..... B65D 55/02 215/230

(Continued)

FOREIGN PATENT DOCUMENTS

DE 29600635 2/1997
DE 102005013435 A1 9/2006

(Continued)

*Primary Examiner* — J. Gregory Pickett
*Assistant Examiner* — Gideon Weinerth
(74) *Attorney, Agent, or Firm* — Pearne & Gordon LLP

(57) ABSTRACT

A safety capsule for containers, comprising: an external cap (2), provided with coupling means for the coupling thereof to the neck (C) of a container; an internal element (3), located inside the external cap (2) and configured to be associated, in a removable manner, with an opening (A) of the container; connecting means (4, 5), interposed between the external cap (2) and the internal element (3), and structured so as to leave the external cap (2) and the internal element (3) unconstrained with respect to a movement for opening or removal of the external cap (2) between a closed position and an intermediate position, and solidly constrain the external cap (2) and the internal element (3) with respect to the movement for opening or removal of the external cap (2) between the intermediate position and an opening position.

23 Claims, 19 Drawing Sheets

(58) Field of Classification Search
CPC ..... B65D 50/045; B65D 2101/00; B65D 2101/069; B65D 41/3404; B65D 41/28
USPC ..... 215/329, 203, 211, 220, 230
See application file for complete search history.

(56) References Cited

U.S. PATENT DOCUMENTS 2,414,420 A * 1/1947 Sebell ..... B65D 55/12 215/230
2,597,307 A * 5/1952 Elkind ..... B65D 50/041 215/220
2,939,597 A 6/1960 Greene
3,073,468 A * 1/1963 Arneson ..... B65D 55/026 215/230
3,712,498 A * 1/1973 Lawrence ..... B65D 51/002 215/247
3,733,001 A * 5/1973 Gach ..... B65D 41/06 215/217
3,845,874 A * 11/1974 Robbins ..... B65D 50/061 215/214
4,156,489 A * 5/1979 Kong ..... B65D 50/045 215/214
4,440,306 A * 4/1984 Van Buskirk ..... B65D 55/02 215/230
4,446,979 A * 5/1984 Gach ..... B65D 41/28 215/203
4,500,005 A * 2/1985 Forrester ..... B65D 55/022 215/203
4,526,281 A * 7/1985 Herr ..... B65D 55/02 215/211
4,527,701 A * 7/1985 Schaubeck ..... B65D 50/041 215/220
4,603,785 A * 8/1986 Gach ..... B65D 55/066 215/230
4,669,620 A * 6/1987 Coifman ..... B65D 55/024 215/220
4,723,673 A * 2/1988 Tartaglia ..... B65D 55/026 215/230
4,747,497 A * 5/1988 Holman ..... B65D 79/005 215/230
4,793,504 A * 12/1988 Towns ..... B65D 55/02 206/807
5,035,341 A * 7/1991 Heilman ..... B65D 55/066 215/230
5,074,424 A * 12/1991 Heilman ..... B65D 55/066 215/230
5,092,477 A * 3/1992 Johnson, Jr. ..... B65D 55/066 215/220
5,115,929 A * 5/1992 Buono ..... B65D 50/041 215/216
5,381,917 A * 1/1995 Santagiuliana ..... B65D 50/041 220/219
5,511,677 A * 4/1996 Oder ..... B65D 41/3404 215/230
5,605,240 A * 2/1997 Guglielmini ..... B65D 41/485 215/235
5,884,788 A 3/1999 Wilde
6,000,568 A * 12/1999 Verter ..... B65D 41/3404 215/230
6,373,786 B1 * 4/2002 Kagan ..... B65D 79/02 368/10
7,000,790 B1 2/2006 Bae
7,097,058 B2 * 8/2006 Wellman ..... B65D 47/0828 215/217
8,381,924 B2 * 2/2013 Parrinello ..... B26F 1/18 215/349
8,453,856 B2 6/2013 Skelton et al.
8,627,968 B2 * 1/2014 Baban ..... B65D 55/022 215/217
8,851,310 B2 * 10/2014 Pucci ..... B65D 51/228 215/252
2007/0090110 A1 * 4/2007 Skelton ..... B65D 41/0478 220/254.9
2009/0314776 A1 * 12/2009 Pucci ..... B65D 47/0838 220/240
2010/0170898 A1 7/2010 Skelton et al.
2010/0264108 A1 10/2010 Baban
2012/0138561 A1 * 6/2012 Brozell ..... B65D 50/041 215/220
2016/0159537 A1 * 6/2016 Pucci ..... B65D 41/045 215/329

FOREIGN PATENT DOCUMENTS

EP 1413526 A1 4/2004
GB 2107290 A 4/1983
GB 2450940 A 1/2009

* cited by examiner

SAFETY CAPSULE FOR CONTAINERS

The object of the present invention is a capsule for containers that is provided with an indicator signalling that opening has taken place.

In particular, the invention refers to a capsule configured for application to the neck of a container.

Several types of capsules designed for application to the neck of a container are currently present on the market. Such capsules are largely used for closing bottles of water and soft drinks, milk containers, containers for fruit juices and other foods or liquid substances.

In addition to realizing a hermetically sealed closure immediately following the packaging of the product inside the container, and possibly also after the container has been opened for the first time, capsules of the type at hand must provide an immediate indication signalling that the first opening of the container has taken place. This is because the consumer must clearly be able to realize immediately the state of the container about to be purchased or opened for the first time. For obvious reasons concerning safety, upon the first opening, the container must be in an intact condition.

The capsules currently available perform the function of indicating the intactness thereof by means of various components.

The most widely used component is constituted by a ring-shaped element, also called an intactness or safety strip, which is associated with a lower edge of the capsule by means of a breakable connection. Upon the first opening of the capsule, the intactness strip remains connected to the neck of the container, but it detaches from the edge of the capsule. In addition to increasing the dimensions of the capsule in the axial direction, the use of an intactness strip does not, in any case, offer in particular high assurance of intactness. In fact, by carefully removing the capsule and slightly forcing the widening of the intactness strip, it is possible to have the strip slide off the neck of the container without causing its detachment from the capsule. Moreover, the presence of the safety strip makes the phase consisting of the first application of the capsule to the container relatively complex, besides increasing the weight and the cost of the capsule itself.

The use of small discs or films is provided for as an alternative to the intactness strip, and in a phase following the insertion of the product in the container, they are applied to the neck or to the opening of the container itself. Upon the first opening, after having removed the capsule, the consumer removes the small disc or film, which cannot be reapplied subsequently to the neck or the opening of the container. These components do not offer in particular high assurance of intactness either, as they can be easily perforated in a manner that is not visible. Moreover, it is often difficult for the user to remove them, and additionally they complicate the product packaging process.

Capsules are also proposed that are equipped with means for indicating that the first opening has taken place, by means of the appearance of a signal or writing visible on the outside the capsule. These capsules generally comprise an external cap designed to screw onto the neck of the container, and a small disc or another safety guarantee component, which, at least in a configuration preceding the first opening of the capsule, is removably constrained to the neck or the opening of the container. The external cap is provided with a window overlying the safety guarantee disc that bears in the upper part thereof a signal indicating that the first opening has taken place. Upon the first opening of the capsule, the external cap and the disc can rotate with respect to each other between an unaligned position, in which the signal indicating that the first opening has taken place is not visible from the outside, and an aligned position, in which the signal indicating that the first opening has taken place is visible from the outside through the window on the external cap. Besides being quite complex to realize, capsules of this type are not adequately irreversible. Essentially, once the first opening of the capsule has taken place, no means are provided that effectively prevent the external cap and the safety guarantee disc from being brought back into the position preceding the first opening.

The aim of the present invention is to offer a capsule that makes it possible to overcome the drawbacks of the known types of capsules.

One advantage of the capsule according to the present invention is that it enables immediate identification of the first opening of the container to which it is applied, without any need for a safety strip or other components.

Another advantage of the capsule according to the present invention is that it is easily activated by the user, by means of a simple opening rotation.

Another advantage of the capsule according to the present invention is that it is absolutely irreversible, that is, following the first opening, it cannot be brought back into a configuration preceding that of the completed first opening.

Further characteristics and advantages of the present invention will become more apparent from the following detailed description of an embodiment of the invention, which is illustrated by way of non-limiting example in the accompanying Figures, in which:

FIGS. 1, 2 and 3 are schematic views of a first embodiment of the capsule according to the present invention, in which an external cap (2) is shown in phantom;

FIG. 2*a* is an alternative embodiment of the solution of FIG. 2.

FIG. 4 is a sectional view of the capsule appearing in FIGS. 1 to 3;

FIGS. 5*a*, 5*b* 5*c* and 5*d* are schematic views of a second embodiment of the capsule according to the present invention, in which the external cap (2) is shown in phantom or in a sectional view;

Figure 6:
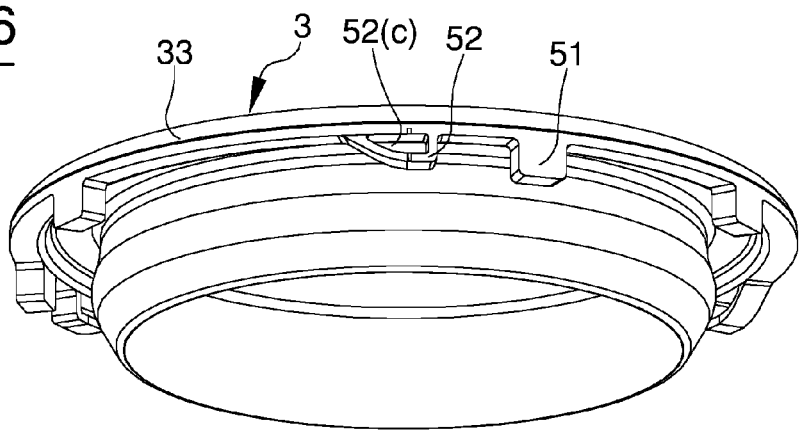
FIG. 6 is a view of a further embodiment of one component of the capsule according to the present invention.
Figure 9A:
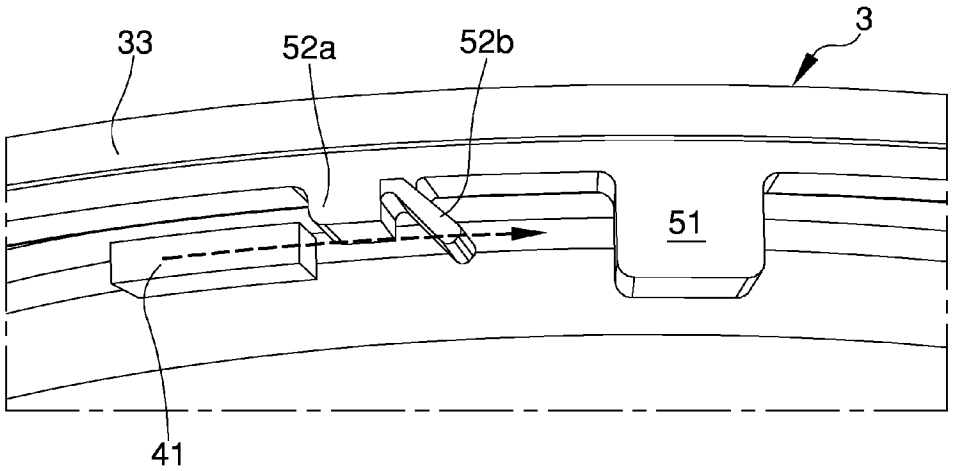
Figure 9B:
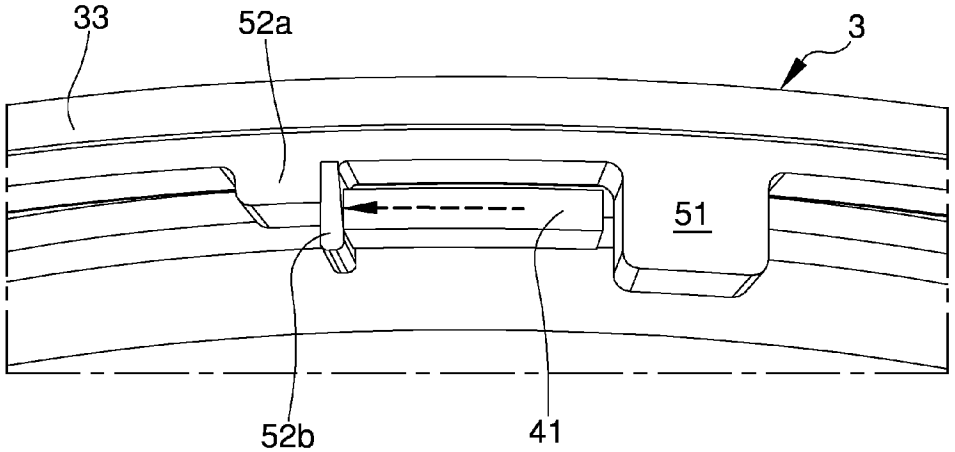
Figure 10A:
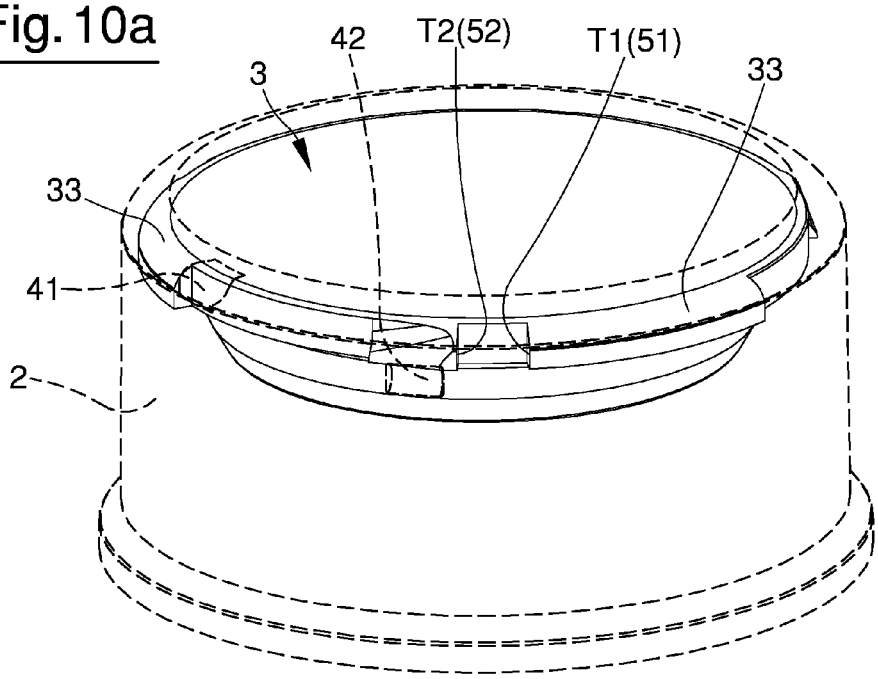
Figure 10B:
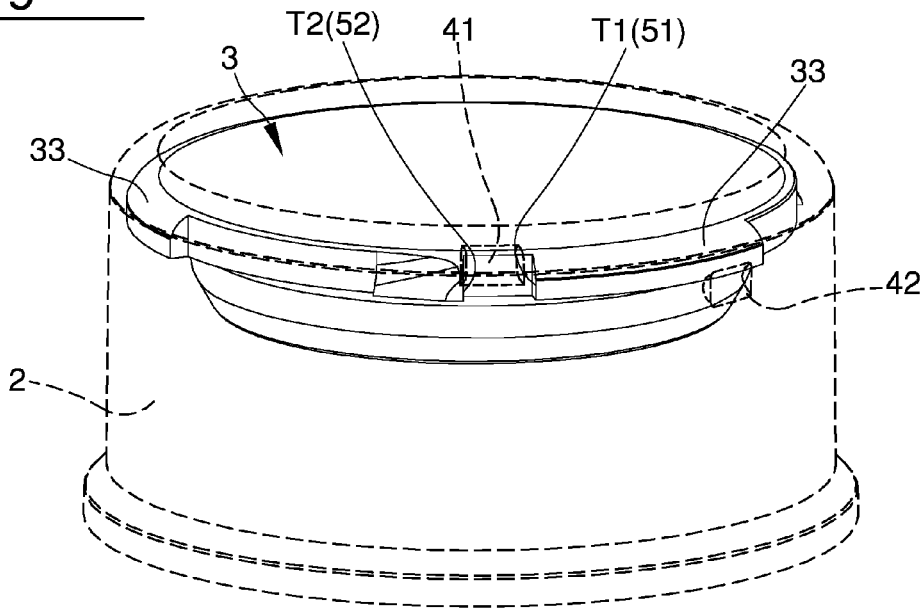
Figure 10C:
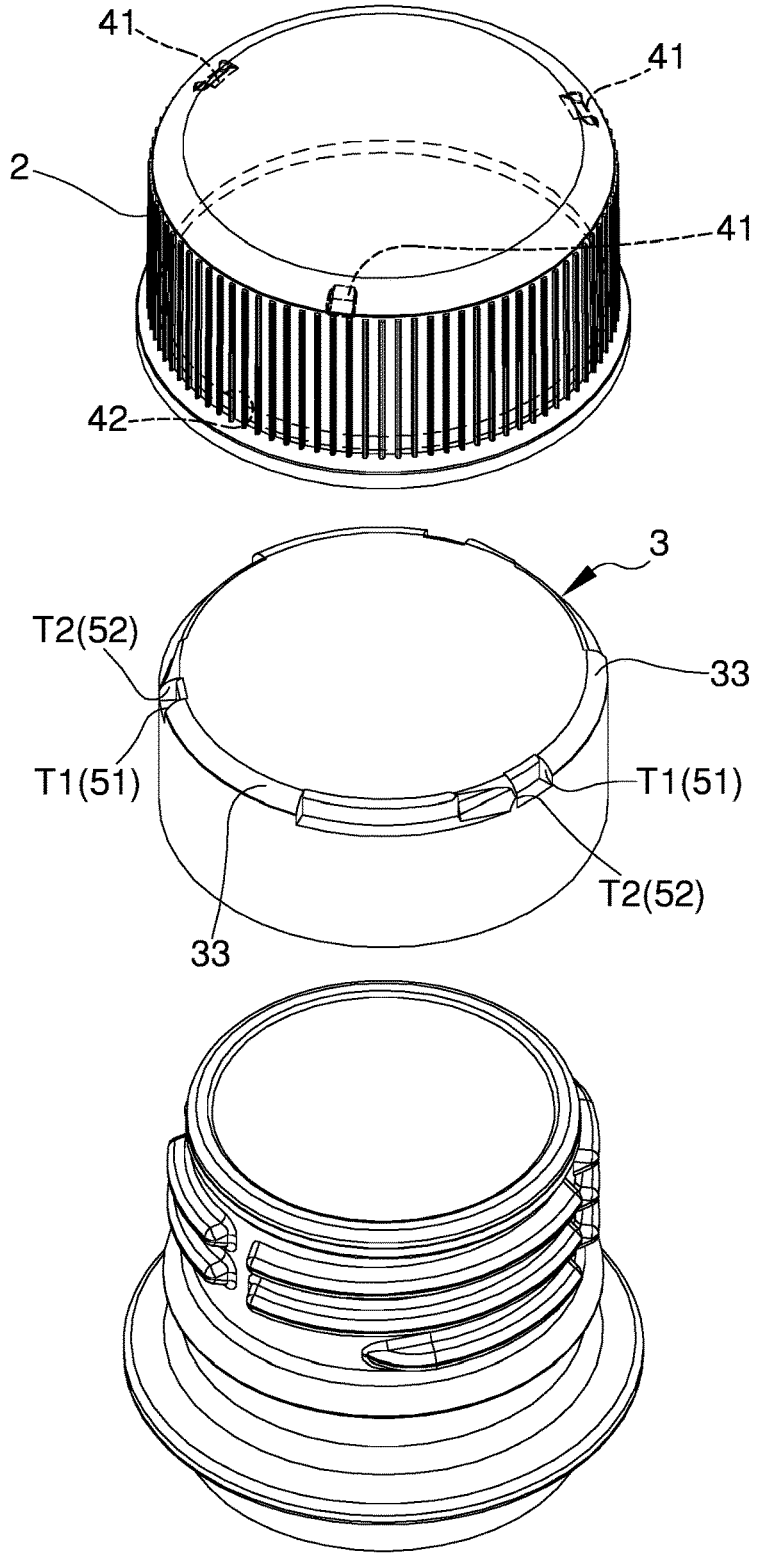
Figure 11A:
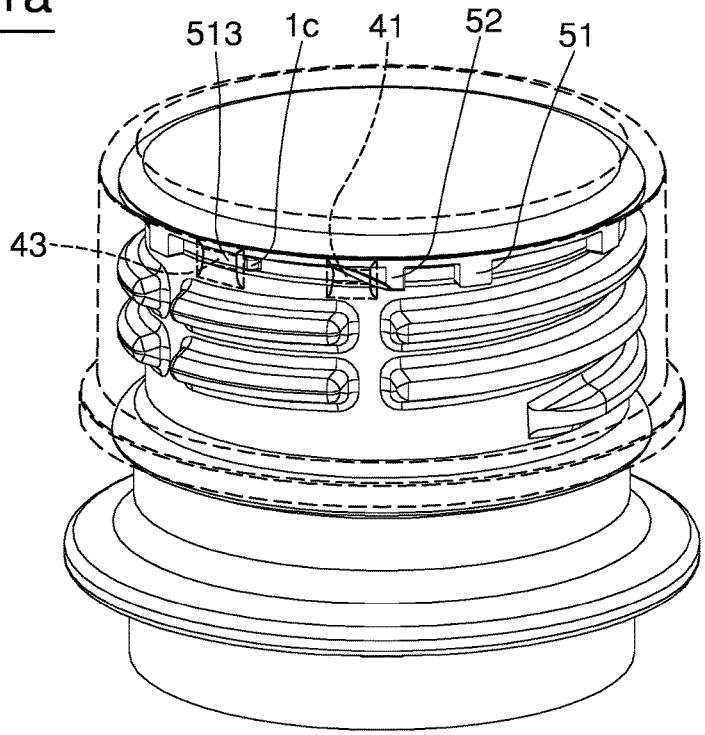
Figure 11B:
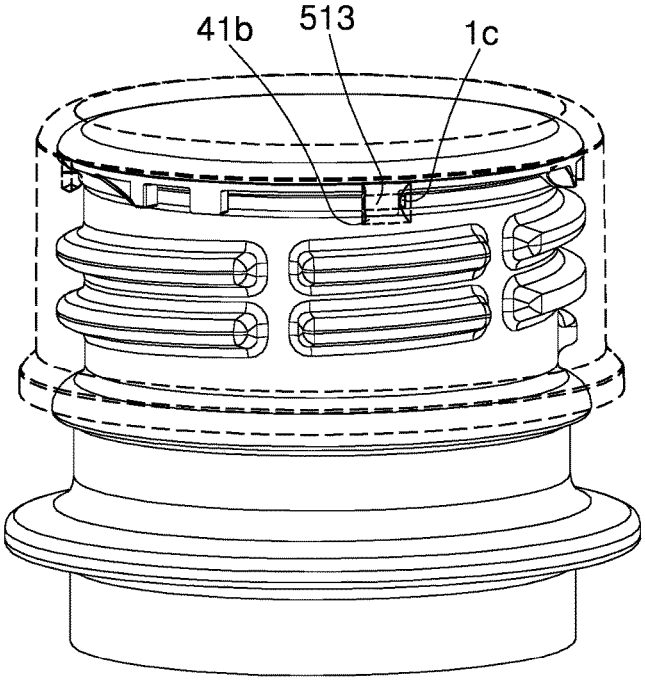
Figure 12:
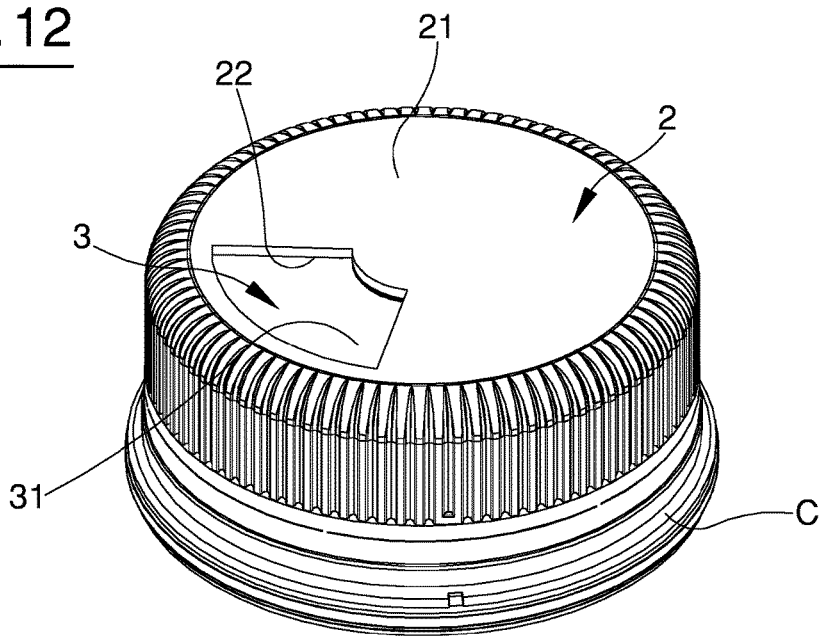
Figure 13:
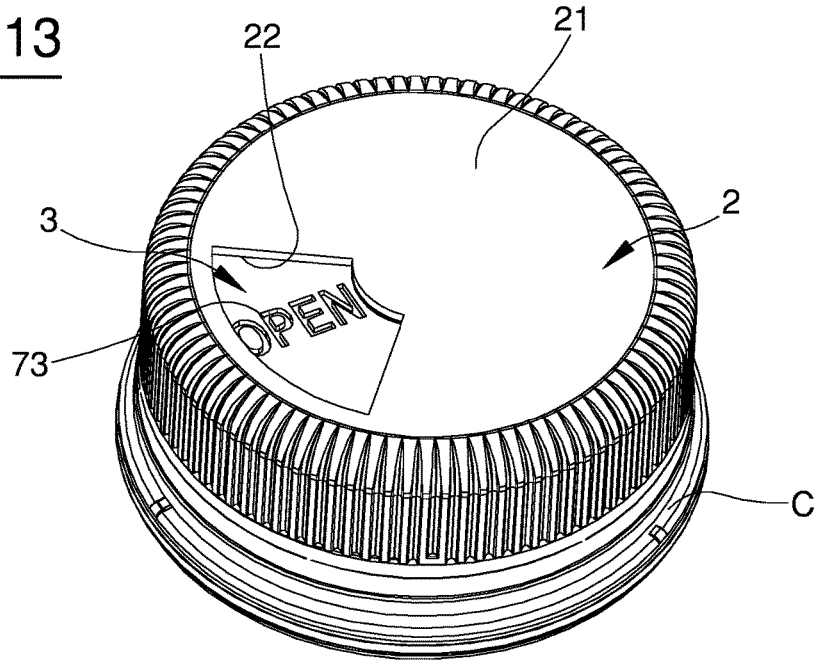
Figure 14:
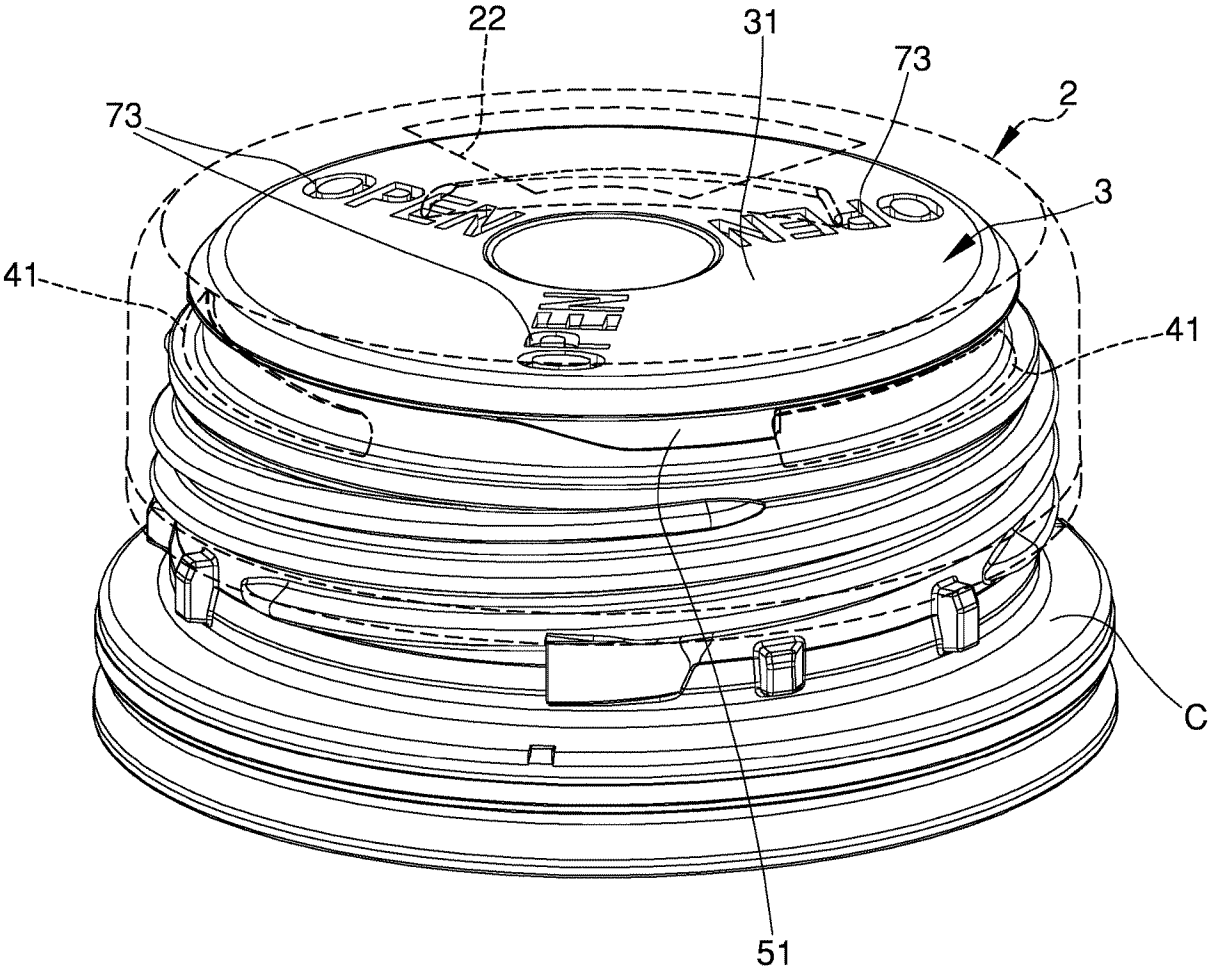
Figure 15:
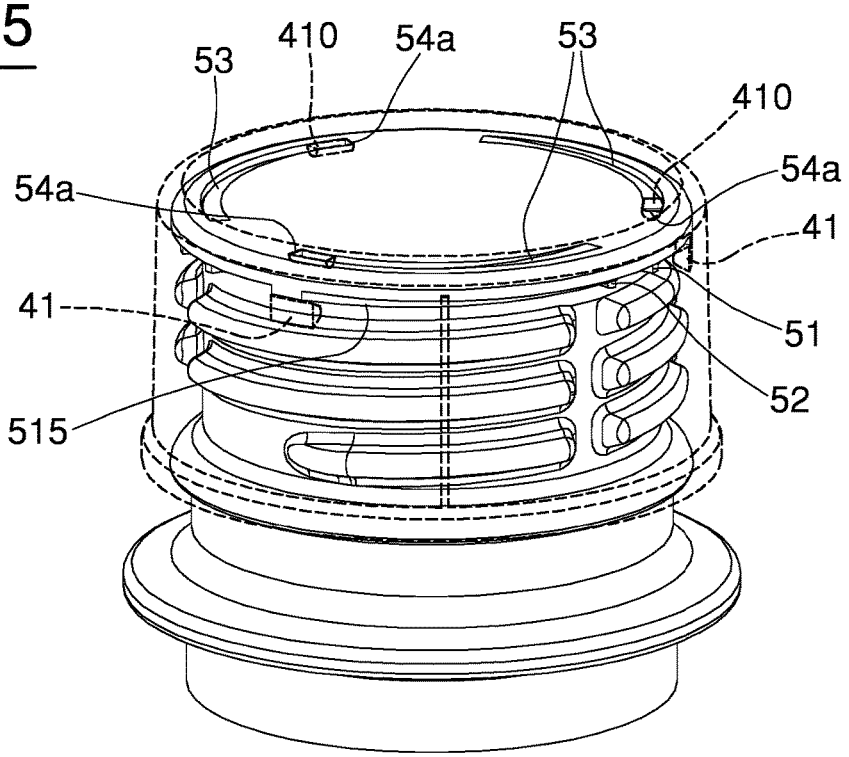
Figure 16:
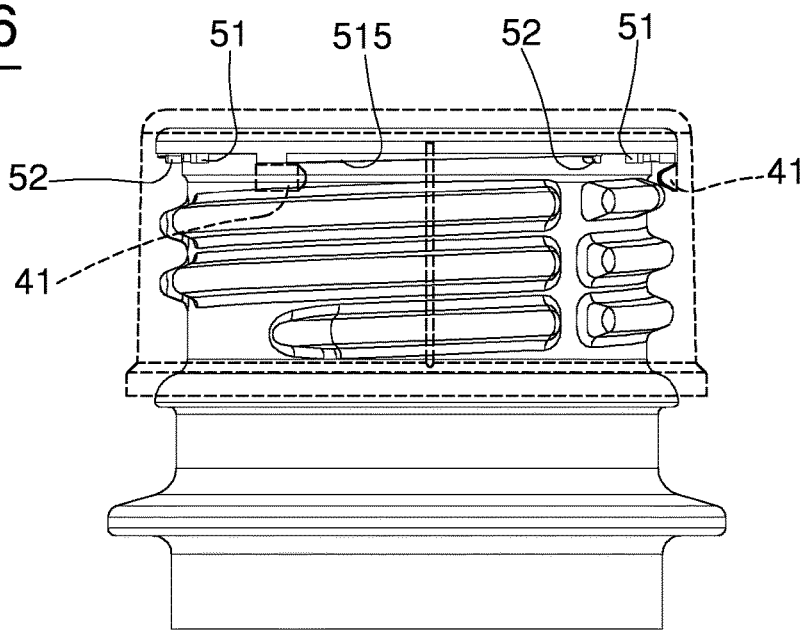
Figure 17:
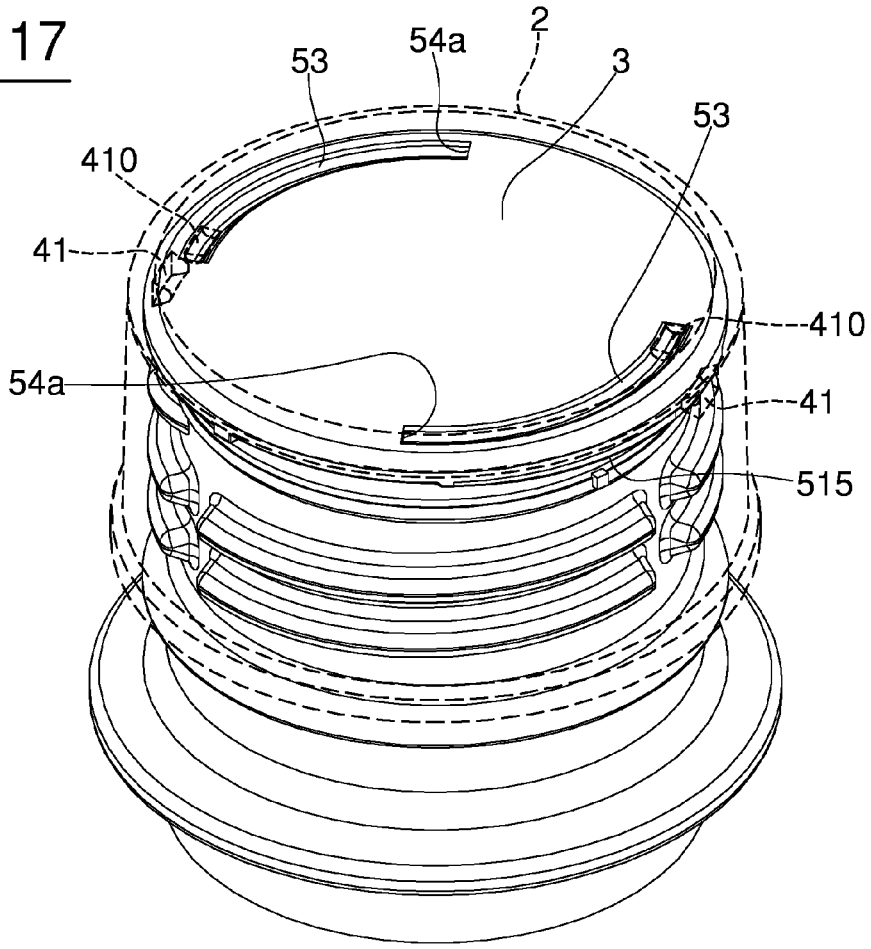
Figure 18:
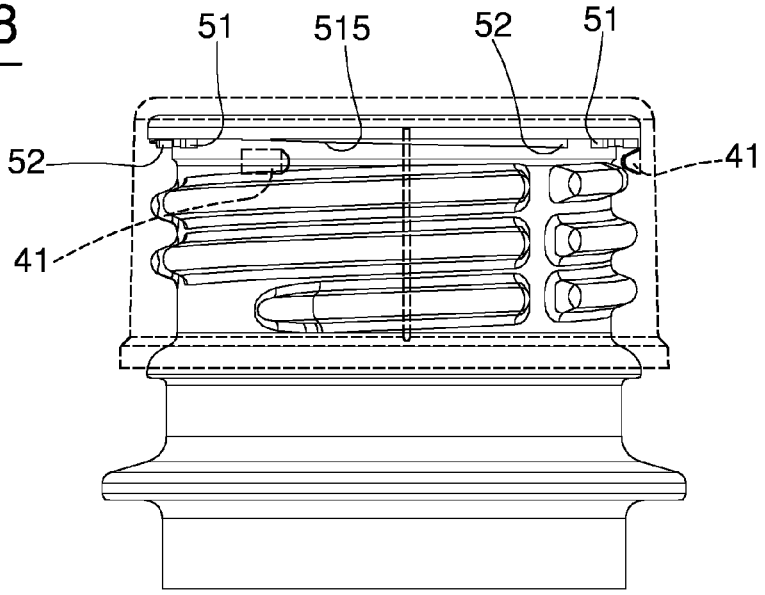
Figure 19:
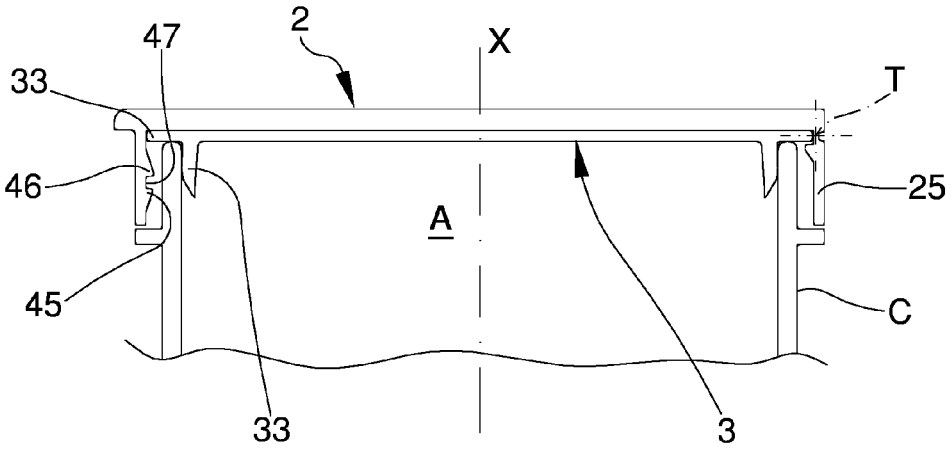
Figure 20:
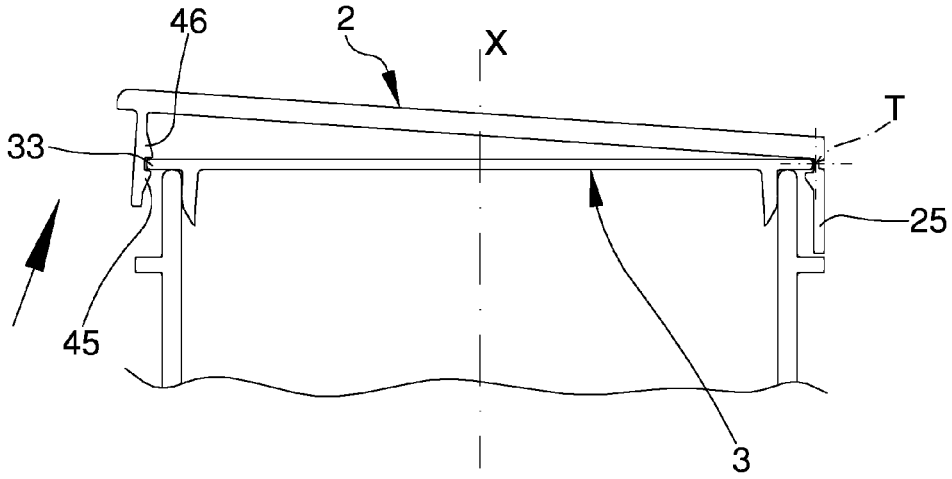
Figure 21:
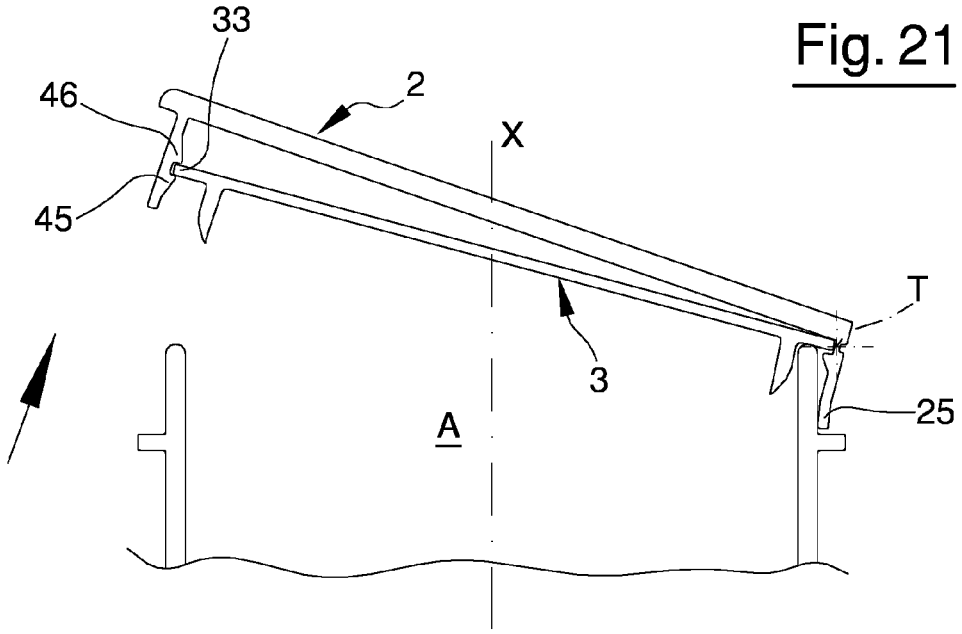
Figure 22:
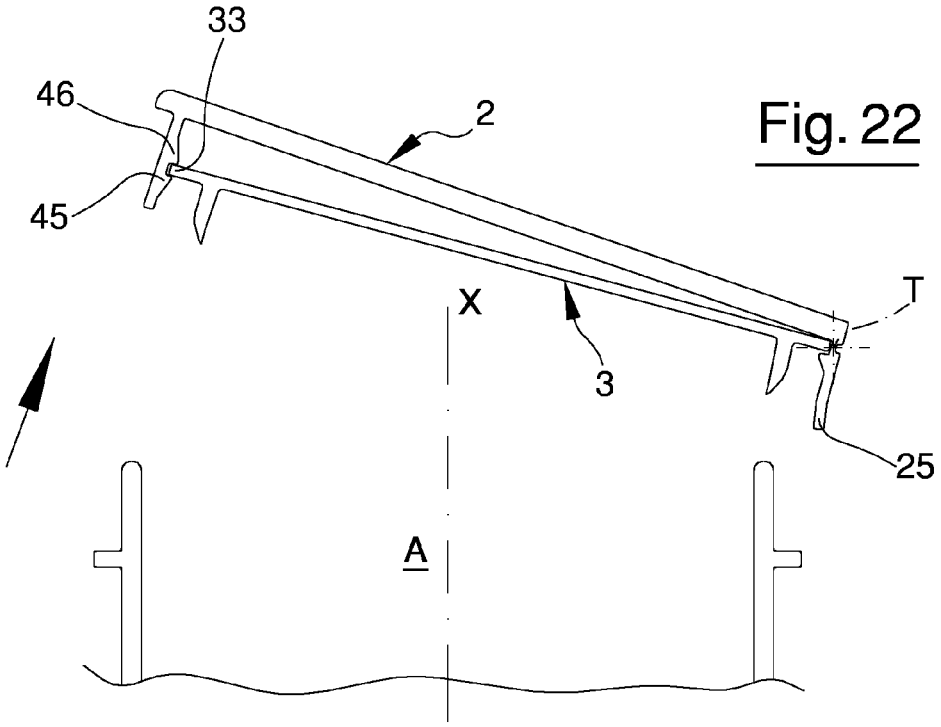

FIGS. 9*a* and 9*b* are a view of a further embodiment of the component of the capsule of FIG. 6, in two operating configurations;

FIGS. 10*a* and 10*b* are two views of a further embodiment of the capsule according to the present invention, in which the external cap (2) is shown in phantom;

FIG. 10*c* is a further embodiment of the capsule according to the present invention;

FIGS. 11*a* and 11*b* are two views of a further embodiment of the capsule according to the present invention, in which the external cap (2) is shown in phantom;

FIG. 12 is a further embodiment of the capsule, in which the external cap (2) is shown in phantom;

FIGS. 13 and 14 are the capsule of FIG. 12 in two operating configurations;

FIGS. 15 and 16 disclose a further embodiment of the capsule;

FIGS. 17 and 18 are a further embodiment of the capsule, in which the external cap (2) is shown in phantom.

FIGS. 19 to 28 are further embodiments of the capsule.

The safety capsule according to the present invention comprises an external cap (2) that is internally provided with means for the coupling thereof to the neck (C) of a container. The coupling between the external cap (2) and the neck (C) of the container can be realized in various manners, for example by means of threading, snap-on or bayonet couplings. Generally, three types of couplings are distinguishable: a first type that comprises at least one rotation movement of the external cap (2) with respect to the neck (C) about a longitudinal axis (X), a second type of coupling comprising at least one sliding movement of the external cap (2) along the longitudinal axis (X), and a third type of coupling comprising a rotation of the external cap (2) about an axis perpendicular to the longitudinal axis (X), that is, a hinged movement.

The external cap has an upper portion (21) that is preferably circular in shape, and from which a lateral portion (23) extends substantially concentric with the longitudinal axis (X). In the case in which a threaded coupling with the neck (C) is provided, the threading for coupling to the neck (C) of the container can be fashioned on an inner surface of the lateral portion (23).

The capsule further comprises an internal element (3) located inside the external cap (2) and that is configured to be associated, in a removable manner, with an opening (A) of the container. As shown in the Figures, the internal element (3) may have the form of a disc, shaped in such a manner as to be insertable, at least partially, inside the opening (A), realizing therein an interference fit seal. In this embodiment, the safety guarantee element comprises an upper portion (31) that is substantially flat and circular in shape, below which a lower portion (32) is located. This lower portion (32) is intended for insertion in the opening (A), whereas the upper portion (31) is structured so as to enable placement in contact with the upper edge of the opening (A). The upper portion (31) is preferably of a larger diameter than the lower portion (32), so that a projecting edge (33) of a substantially annular shape and concentric with the longitudinal axis (X) is defined between said portions (31, 32).

As can be seen in the Figures, the internal element (3) is located below the upper portion (21) of the external cap (2), in proximity to or in contact with the upper portion (21). When the external cap (2) is applied on the neck (C) of the container in a position of complete closure, the lower portion (32) of the internal element (3) is inserted, as mentioned previously, in the opening (A). The internal element (3) can be firmly constrained to the external cap (2) with respect to direct movements along the longitudinal axis (X), or constrained with some clearance and with the possibility of performing limited movements along the longitudinal axis (X).

In an alternative embodiment, which is shown in FIGS. 9 to 11, the internal element (3) is configured to be connected to the neck (C) of a container by means of a breakable edge. Essentially, the internal element (3) can be made together as a single piece with the neck (C) of the container, predisposing a breakable joint edge or zone. Upon the first opening of the container, the internal element (3) detaches from the neck (C) of the container.

Connecting means (4, 5) are interposed between the external cap (2) and the internal element (3). The connecting means (4, 5) are structured so as to leave the external cap (2) and the internal element (3) unconstrained with respect to a movement for opening or removal of the external cap (2) between a closed position and an intermediate position, and to solidly constrain the external cap (2) and the internal element (3) with respect to the movement for opening or removal of the external cap (2) between the intermediate position and an opening position. Before the position of closure, or after the position of closure, a rotation portion could be present in which the external cap (2) and the internal element (3) are not unconstrained from each other with respect to the rotation, but this does not influence the operation of the capsule. What is essential is that, upstream of the intermediate position, there is at least one portion in which the external cap (2) and internal element (3) are unconstrained from each other in rotation.

In a first embodiment of the capsule, the external cap (2) is coupled to the neck (C) by a coupling means that provides for at least one initial rotation for the opening or the removal of the external cap itself, for example a threading or a cam or bayonet coupling, a rotation that also entails an axial movement. Considering an initial condition in which the capsule is applied on the neck of the container in a position of complete closure, with the internal element (3) associated with the opening (A) of the container, the connecting means (4, 5) are structured so as to enable one opening rotation of the external cap (2) with respect to the internal element (3), up to a given intermediate position. Essentially, during this rotation, the internal element (3) remains stationary, in that it is associated with the neck (C), whereas the external cap unscrews partially from the neck (C) of the container, while also shifting axially. In the intermediate position, the connecting elements (4, 5) intervene, thereby solidly constraining the external cap (2) and the internal element (3) with respect to the opening rotation. The connecting means (4, 5) are also structured so as to solidly constrain the external cap (2) and the internal element (3) with respect to the axial movement, at least in the direction of lifting the capsule from the neck (C) starting from a given position of the external cap (2).

The conformation and the structure of the connecting means (4, 5) thus make it possible to divide the opening rotation of the capsule (1) into at least two consecutive phases. In a first phase, which extends over an angle comprised between the closed position and the intermediate position, the external cap (2) rotates, while the internal element (3) remains stationary. Then, when the external cap (2) reaches the intermediate position, the connecting means (4, 5) intervene, solidly constraining the external cap (2) and the internal element (3) with respect to the opening rotation. The relative rotation between the external cap (2) and the internal element (3) can be utilized advantageously as an indication signalling that the first opening of the container has taken place, as will be made clear below in the description.

The connecting means (4, 5) comprise at least a first connecting element (4), solidly constrained to the external cap (2), and at least a second connecting element (5), solidly constrained to the internal element (3).

Figure 1:
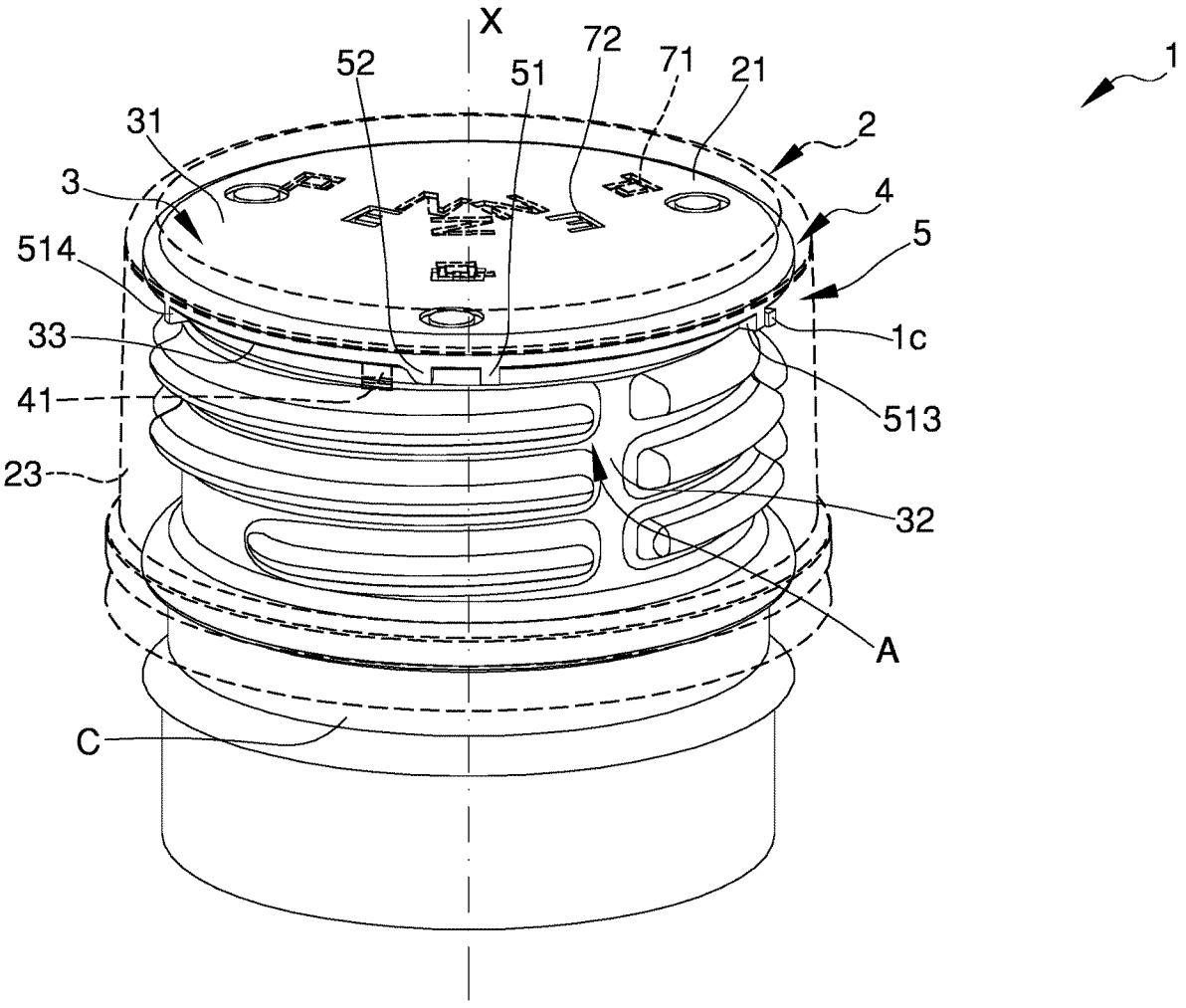
Figure 2:
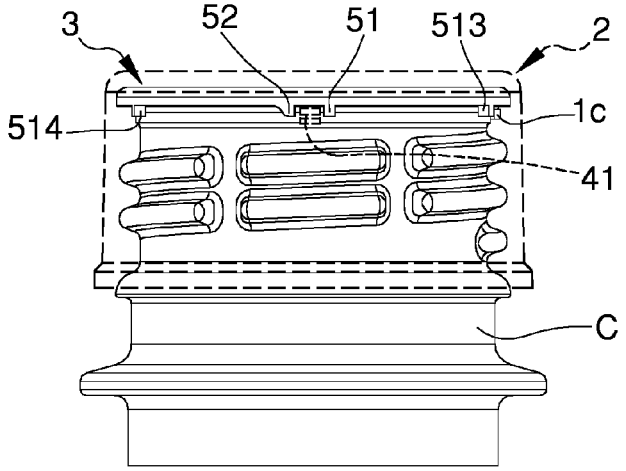

In a first embodiment of the connecting means, the first connecting element (4) comprises a small tooth (41) which projects from an inner surface of the external cap (2) and faces the internal element (3). As can be seen in FIGS. 1 and 2, the small tooth (41) projects radially from the inner surface of the external cap (2), in particular of the lateral portion (23). The external cap (2) can be provided with more teeth (41), evenly distributed along a circumference concentric with the longitudinal axis (X), on a plane perpendicular to the longitudinal axis (X) itself.

In addition to interacting with the second connecting element (5), the first small tooth (41) is also structured so as to retain the internal element (3) inside the external cap (2), with or without a given axial clearance. The tooth (41) projects beneath the projecting edge (33) of the internal element (3), so as to prevent the internal element from sliding off the external cap (2). When the external cap (2) is removed from the neck (C) of the container, the retention performed by the first small tooth (41) also enables the internal element (3) to be removed with the external cap (2) itself. Moreover, the small tooth (41) serves to lift the internal element (3) during the opening rotation of the external cap (2).

The second connecting element (5) comprises a first small tooth (51) that projects from an external surface of the internal element (3) and faces the external cap (2). Preferably, the first small tooth (51) is associated with the projecting edge (33) of the internal element (3), projecting downwards.

As can be seen in FIGS. 1 and 2, the small tooth (41) of the external cap (2) and the first small tooth (51) of the internal element (3) are arranged at a distance from the longitudinal axis (X), the distance being such as to enable contact between them in the intermediate opening position. Starting from an initial condition in which the capsule (1) is completely screwed onto the neck (C) in the closed position, in the course of the opening rotation of the external cap (2), the small tooth (41) of the external cap (2) comes into contact with the first small tooth (51) of the internal element (3) in the intermediate opening position. Continuing the opening rotation from the intermediate position, the external cap (2) drags the internal element (3) into rotation, by virtue of the contact between its own small tooth (41) and the first small tooth (51) of the internal element (3).

When the capsule is applied to the container for the first time, that is, during the closing rotation of the external cap (2), the internal element (3) and the external cap (2) rotate solidly constrained with respect to the neck (C). During the closing rotation, at a certain point the internal element (3) comes into contact with the neck (C), so that friction is produced therebetween, which tends to block the rotation of the internal element (3). However, the external cap (2) is able to continue rotating at least until reaching a position in which the small tooth (41) of the external cap (2) comes into contact with the first small tooth (51) or with a possible additional abutment tooth (514) solidly constrained to the internal element (3), so that a given angular displacement is produced between it and the internal element (3).

In an unillustrated alternative embodiment, the small tooth (41) of the external cap (2) may comprise an end section of the thread located internally of the external cap (2) itself for coupling to the neck (C) of the container.

Advantageously, the second connecting element (5) comprises a second small tooth (52), alongside the first small tooth (51) in such a manner as to define a shaped space for receiving the first connecting element (4) in the intermediate opening position. The second small tooth (52) is preferably associated with the projecting edge (33) of the internal element (3), projecting downwards. The second small tooth (52) is located upstream of the first small tooth (51) with respect to the opening rotation of the external cap (2). The second small tooth (52) preferably has an external side, facing the opposite side that of the first small tooth (51) and shaped so as to facilitate passage over the small tooth (41) of the external cap (2) during the opening rotation of the external cap (2). As shown in FIGS. 1 and 2, the external side of the second small tooth (52) is radiused or inclined in a ramp-like fashion from the base towards the top of the second tooth (52) itself. During the opening rotation of the external cap (2), the small tooth (41) of the external cap (2) encounters the second small tooth (52) and slides over it, partially bending and/or causing partial bending of the second small tooth (52) as well, until it passes over the latter and positions itself in the space defined between the first tooth (51) and the second tooth (52), in the intermediate opening position. In this position, the external cap (2) and the internal element (3) are solidly constrained to each other with respect to the rotation about the longitudinal axis (X) in both directions. In fact, the second small tooth (52) is structured so as to prevent passage over the small tooth (41), with respect to a rotation in the closing direction. Upon reaching the intermediate opening position, that is, as soon as the small tooth (41) of the external cap (2) has passed over the second small tooth (52) and is located between the latter and the first small tooth (51), a short click is produced which is perfectly perceptible by the user and indicates that the first opening of the capsule (1) has taken place.

In an embodiment shown in FIGS. 5*a*,5*b*,5*c*,5*d*, the second small tooth (52) has a thickness, measured in a radial direction, which increases nearer to the first small tooth (51). The height of the second small tooth (52), meant as along a direction parallel to the rotation axis of the external cap (2), increases nearer to the first small tooth (51).

During the rotation of the external cap (2) in the opening direction, the small tooth (41) of the external cap (2) comes into contact with the portion of least thickness of the second small tooth (52). Owing to the effect of the contact with the small tooth (41) of the external cap (2), the second small tooth (52) bends toward the inside, facilitating passage over the small tooth (41) itself.

In the embodiment of FIGS. 5*a*,5*b*,5*c*,5*d*, a projecting edge (101) is solidly constrained to the neck (C) of the container. The projecting edge (101) is structured so as to come into contact with the small tooth (52) downstream of the intermediate position and to bend the second small tooth (52) outward.

The projecting edge (101) has the function of bringing the second small tooth (52) back into the position preceding the passage over the small tooth (41) of the external cap (2). This occurs since, following the passage of the second small tooth (52), the small tooth (41) of the external cap (2) abuts against the first small tooth (51), as already described for the previous embodiments. From this moment on, the external cap (2) and the internal element (3) continue solidly constrained in the opening rotation. The second small tooth (52) thus slides in contact with the projecting edge (101), bending outward and returning into a configuration preceding the passage over the small tooth (41) of the external cap (2).

In a further embodiment, illustrated in FIG. 6, the second small tooth (52) has a cavity (52C). This cavity has the function of increasing the flexibility of the second small tooth (52) to facilitate passage of the small tooth (41) of the external cap (2). The cavity (52C) may pass through the entire thickness of the second small tooth (52), or else it may not pass therethrough.

Figure 7:
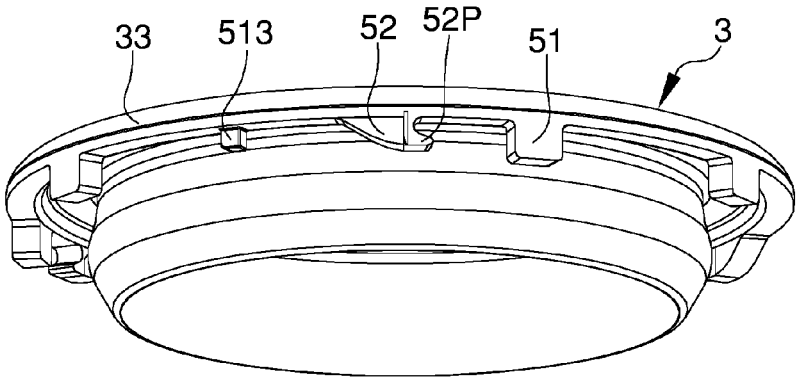
FIG. 7 is a view of a further embodiment of the component of the capsule of FIG. 6.

In a further embodiment, shown in FIG. 7, the second small tooth (52) has an appendage (52P) facing the first small tooth (51). The appendage (52P), which has a decidedly smaller cross section than the second small tooth (52), is structured to bend upwards upon the passage of the small tooth (41) of the external cap (2) during the opening rotation, so as to facilitate passage. Following the passage, the appendage (52P), being faced towards the first small tooth (51), obstructs and prevents a passage the small tooth (41) of the external cap (2) in the opposite direction, maintaining it positioned between the first small tooth (51) and the second small tooth (52). The appendage (52P) could also be facing downward and/or be conformed in another manner, while maintaining a structure capable of obstructing the passage of the small tooth (41) in the direction opposite that of the unscrewing rotation.

Figure 8:
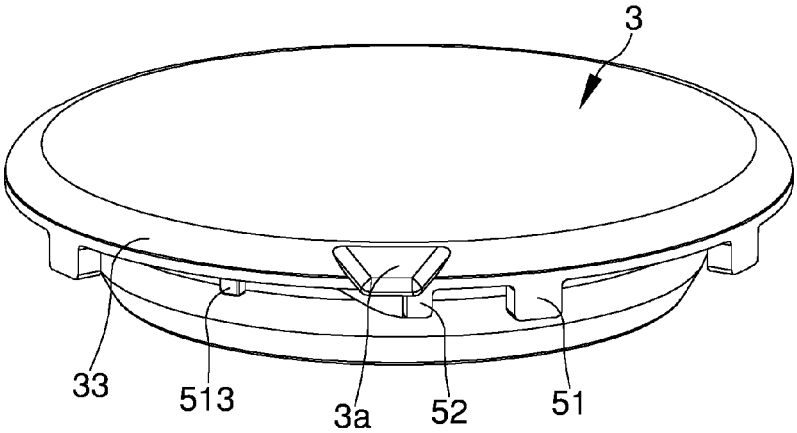
FIG. 8 is a view of a further embodiment of the component of the capsule of FIG. 6.

To facilitate the upward bending of the second small tooth (52), and thus to facilitate passage of the small tooth (41) of the external cap (2), the internal element (3) comprises a recess (3A) disposed above the second small tooth (52), as shown in FIG. 8. The recess (3A) locally reduces the thickness of the internal element (3), facilitating the upward bending of the second small tooth (52).

In a further embodiment, shown in FIGS. 9*a* and 9*b*, the second small tooth (52) comprises a first portion (52*a*) and a second portion (52*b*). The first portion (52*a*) is structured in such a way as not to interact, or to interact only to a limited degree, with the small tooth (41). Essentially, the first portion (52*a*) is structured in such a way as to enable, during the rotation of the external cap (2), the passage of the small tooth (41), substantially without interfering, or interfering in a limited manner. The second portion (52*b*) is structured to interact with the small tooth (41) and is deformable along a circumferential direction relative to the first portion (52*a*).

The second portion (52*b*) is located on the side of the first small tooth (51), that it, it is located between the first portion (52*a*) and the first small tooth (51). As shown in FIG. 9*a*, during the opening rotation of the external cap (2), the small tooth (41) comes into contact with the second portion (52*b*), which bends toward the first small tooth (51), enabling the passage of the small tooth (41) of the external cap (2). However, the second portion (52*b*) does not enable the reverse passage of the small tooth (41) of the external cap (2), since, being pushed by the small tooth (41), it rests against the first portion (52*a*) without being able to bend any further.

In a further embodiment, shown in FIGS. 10*a*,10*b*, the internal element (3) comprises a projecting edge (33) endowed with at least a transverse surface (T1) that defines the first small tooth (51). The transverse surface (T1) is disposed with a substantially radial orientation, so as to intercept the trajectory followed by the small tooth (41) of the external cap (2) during the opening rotation. At the moment in which the small tooth (41) is placed in contact with the transverse surface (T1), the intermediate opening position is defined, as in the other described embodiments.

The projecting edge (33) is preferably endowed with at least a second transverse surface (T2), which is facing the first transverse surface (T1) and defines the second tooth (52). The portion of the projecting edge (33) that projects from the second transverse surface (T2) away from the first transverse surface (T1) is preferably shaped like a decreasing ramp, that is, it has a radial extension that decreases with increasing distance from the first transverse surface (T1). This conformation facilitates passage by the small tooth (41) over the second transverse surface (T2), since, during rotation of the external cap (2) in the opening direction, the small tooth (41) encounters the projecting edge (33) in the zone of least radial extension. As it slides over the projecting edge (33), the small tooth (41) is thus guided outward until passing over the second transverse surface (T2) and being disposed between the latter and the first transverse surface (T1). Like the second small tooth (52) of the other embodiments, the second transverse surface (T2) prevents the small tooth (41) of the external cap (2) from being able to return into a position preceding the intermediate opening position.

In the embodiment of FIGS. 10*a*,10*b*, the external cap (2) is preferably provided with a connecting element (42) that projects from an inner surface of the external cap (2) and faces the internal element (3). The connecting element (42) could comprise or consist of a portion of the internal thread of the external cap (2). The connecting element (42) is structured so as to come into contact with the projecting edge (33) in such a way as to retain the internal element (3) inside the external cap (2), with or without clearance. In this manner, the internal element (3) remains solidly constrained to the external cap (2) with respect to axial translation and can be removed jointly with the external cap (2).

In the embodiment of FIG. (10*c*), the internal element (3) is coupled to the neck (C) of the container by means of a thread. From the closed position to the intermediate position, during the opening rotation, the external cap (2) rotates freely relative to the internal element (3). From the intermediate position, the external cap (2) becomes solidly constrained to the internal element (3), which can thus be unscrewed by means of the external cap (2).

To make it easier to reach the intermediate position, and to facilitate passage of the small tooth (41) of the external cap (2) over the small tooth (52) of the internal element (3), if present, the neck (C) of the container can be equipped with an abutment element (1C) that radially projects from the neck (C) itself. The internal element (3) can be provided with a third small tooth (513) that is structured so as to come into contact and interact with the abutment element (1C). This third small tooth (513) is located downstream of the second small tooth (52) in the direction of the opening rotation. During the first opening of the capsule, the third small tooth (513) comes into contact with the abutment element (1C), so that the rotation of the internal element (3) is temporarily blocked. As the opening rotation of the external cap (2) continues, the temporary blocking of the internal element (3) facilitates passage of the small tooth (41) of the external cap (2) over the second small tooth (52) of the internal element (3). Moreover, the third small tooth (513) and the abutment element (1C) are structured in such a manner as to disengage following said passage, owing to the contact between the small tooth (41) and the first small tooth (51) in the intermediate opening position, starting from which the internal element (3) rotates solidly constrained to the external cap (2) due to the contact between the small tooth (41) of the external cap (2) and the first small tooth (51) of the internal element (3). In other words, the third small tooth (513) can pass over the abutment element (1C) owing to the external cap (2) and the internal element (3) being solidly constrained in rotation, starting from the intermediate position, in the opening direction, owing to the elastic deformability of the same two components, and owing to the axial shifting of the internal element (3) due to the opening rotation.

In one embodiment, shown in FIGS. 11*a*,11*b*, the external cap (2) comprises an abutment (43), which projects towards the internal element (3) from an inner surface of the external cap (2). The abutment (43) is positioned in such a way as to be superimposed on the third small tooth (513) in proximity to the intermediate position. In other words, the angular distance between the abutment (43) and the small tooth (41) of the external cap (2) is substantially analogous or slightly smaller than the angular distance between the second small tooth (52) and the third small tooth (513). The angular distance between the abutment (43) and the small tooth (41) of the external cap (2) is such that, when the small tooth (41) encounters the second small tooth (52) and begins passing over it, the abutment element (43) is superimposed on the third small tooth (513), maintaining it in a position in contact with the abutment element (1C). This prevents the third small tooth (513) from being able to pass over the abutment element (1C) by bending.

Figure 2A:
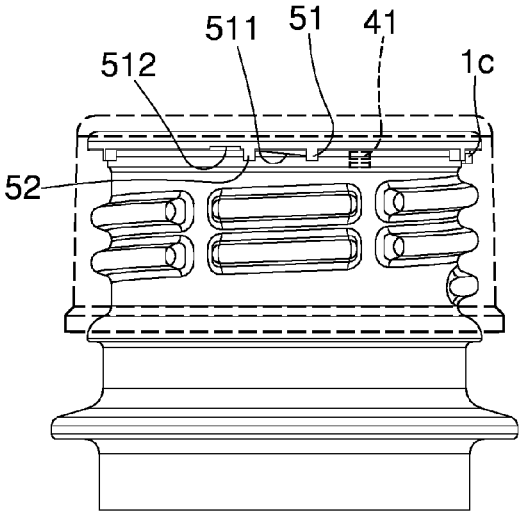

Advantageously, a ramp-shaped section (511), as illustrated in FIG. 2*a*, can be located between the first and the second small tooth (51, 52) of the internal element (3). This ramp-shaped section (511) increases in height starting from the second small tooth (52) towards the first small tooth (51). This conformation of the ramp-shaped section (511) leads to the lifting of the internal element (3) during the opening rotation of the external cap (2) in the tract in which the small tooth (41) of the external cap (2) moves from the second small tooth (52) towards the first small tooth (51). Such lifting of the internal element (3) is useful in facilitating the disengagement of the third small tooth (513) from the abutment element (1C).

Alongside the second small tooth (52), on the opposite side with respect to the first small tooth (51), a notch (512) designed to receive the small tooth (41) of the external cap (2) may also be located. The notch (512) is fashioned in the projecting edge (33) of the internal element (3). Specifically, the projecting edge (33) can be provided with a curved conformation, with at least one portion thereof facing downwards. The notch (512) can be fashioned on this portion of the projecting edge (33) that faces downwards. The notch (512) is structured to receive the small tooth (41) of the external cap (2) at least in the opening rotation tract that precedes the second small tooth (52) of the internal element (3). During the opening rotation of the capsule, this prevents the internal element (3) from lifting and thus causing improper engagement between the third small tooth (513) and the engagement element (1C); the engagement serves to have the small tooth (41) of the external cap (2) pass over the second small tooth (52) of the internal element (3).

In a further embodiment, shown in FIGS. 15 and 16, the capsule comprises a groove (53) fashioned on an upper surface (31) of the internal element (3). Preferably, but not necessarily, the groove (53) has an arc-shaped course concentric with the rotation axis of the external cap (2). A projecting element (410) projects beneath the upper portion (21) of the external cap (2). The projecting element (410) is configured to engage with the groove (53). The groove (53) is shaped so as to produce an axial shift between the internal element (3) and an upper portion (21) of the external cap (2) during the opening rotation.

In the example embodiment shown in FIGS. 15 and 16, the projecting element (410) and the groove (53) are conformed in such a way as to maintain the internal element (3) and the upper portion (21) spaced apart or to gradually distance them during the opening rotation.

The groove (53) can be conformed so as to bring about an axial distancing between the internal element (3) and the upper portion (21) of the external cap (2) during the opening rotation. In this embodiment, the groove (53) decreases in depth in the direction of the opening rotation. The distancing of the internal element (3) and the upper portion (21) of the external cap (2) can be utilized to indicate that the first opening of the capsule has taken place.

In this embodiment, the internal element (3) is further provided with a guide section (515), which is structured so as to interact with the small tooth (41). The guide section (515), which preferably projects downwards from the edge portion (33) of the internal element (3), is inclined in a ramp-like fashion decreasing in the direction of the opening rotation of the external cap (2). In the closing rotation of the external cap (2), the guide section (515) is structured so as to force itself between the connecting element (42) and the upper portion (21) of the external cap (2), so as to eliminate all clearance between the internal element (3) and the external cap (2) in the axial direction.

In the embodiments illustrated in FIGS. 15 and 16, when the capsule is applied to the container for the first time, that is, during the closing rotation of the external cap (2), the internal element (3) and the external cap (2) rotate jointly constrained to the neck (C). During the closing rotation, at a certain point, the internal element (3) comes into contact with the neck (C), so that friction is produced between them which tends to block the rotation of the internal element (3). However, the external cap (2) is able to continue rotating at least until reaching a position in which the projecting element (410) of the external cap (2) comes into contact with an end surface (54*a*) of the groove (53), so that so that a given angular displacement is produced between it and the internal element (3).

As shown in FIGS. 17 and 18, the groove (53) can be conformed so as to bring about an axial nearing between the internal element (3) and the upper portion (21) of the external cap (2) during the opening rotation. In this embodiment the groove (53) increases in depth in the direction of the opening rotation. The nearing of the internal element (3) and the upper portion (21) of the external cap (2) can be utilized to indicate that the first opening of the capsule has taken place. In FIG. 17, the capsule is in the intermediate opening position, and the small tooth (410) is entirely seated in the groove (53). In FIG. 18, on the contrary, the capsule is in the closed position.

In the initial closed position of the capsule, the projecting element (410) can be outside the groove (53). In this manner, the projecting element (410) is interposed between the internal element (3) and the external cap (2), keeping them at a certain distance from each other. During the opening rotation, the projecting element (410) encounters the groove (53) and is located therewithin.

In this case as well, the internal element (3) is provided with a guide section (515), which is structured so as to interact with the small tooth (41). The guide section (515), which preferably projects downwards from the edge portion (33) of the internal element (3), is inclined in a ramp-like fashion increasing in the direction of the opening rotation of the external cap (2). During the opening rotation of the external cap (2), the tooth (41) of the external cap (2) slides along the guide section (515), which is conformed so as to bring about a lifting of the internal element (3). This causes the groove (53) to move near to the projecting element (410) and receive the latter within it.

It is noted that the various components of the connecting means (4,5) which were described as associated with the external cap (2) could be associated with the internal element (3) instead. Conversely, the components of the connecting means (4, 5) which were described as associated with the internal element (3) could be associated with the external cap (2) instead, without the operating principle of the capsule being substantially modified.

In the embodiment of the capsule shown in FIG. 14, the internal element (3) is configured to be connected to the neck (C) of a container by means of a breakable edge. In this embodiment, the second connecting element (5) comprises a cam (51) structured to come into contact with the first connecting element (4) in the intermediate position. The first connecting element (4) comprises a section or cam follower (41) that projects from an inner surface of the external cap (2), and it is shaped and located in such a manner as to enable it to interact with the cam (51). More specifically, the cam (51) is structured so as to bring about a lifting of the internal element (3) towards the external cap (2) during the opening rotation. The opening rotation of the external cap (2), from the intermediate position on, causes the breakage of the joint edge, which leads to the detachment of the internal element (3) from the neck (C) of the container.

With this aim, the capsule according to the present invention is provided with a signalling means (S), which is structured to take on a given configuration at the intermediate position. This configuration can be associated with an indication signalling that the first opening of the capsule has taken place.

For the realization of the signalling means (S), the external cap (2) has at least one transparent or semi-transparent top portion (21). For this purpose, the external cap (2), or at least the top portion (21) thereof, can be made of a translucent material, for example PP copolymer. The top and/or bottom part can be configured, entirely or partially, as a lens or a system of lenses, and possibly be polarized by means of the application of specific films, or the top part can be made locally transparent by varying the surface geometry and/or the roughness thereof in a specific zone. For the realization of the signalling means (S), chemical components can be interposed between the external cap (2) and the internal element (3) and during the first opening of the capsule, upon coming into contact with each other, the components produce a reaction that forms a coloured substance that is visible from the exterior. A further possibility is offered by the utilization of birefringent materials, for example calcium carbonate (CaCO3), in order to obtain the polarization of the top portion (21) of the external cap (2) and the internal element (3).

Figure 3:
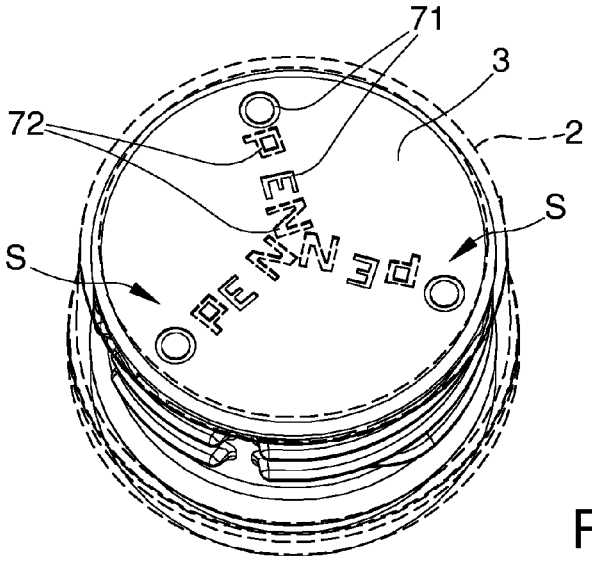
Figure 4:
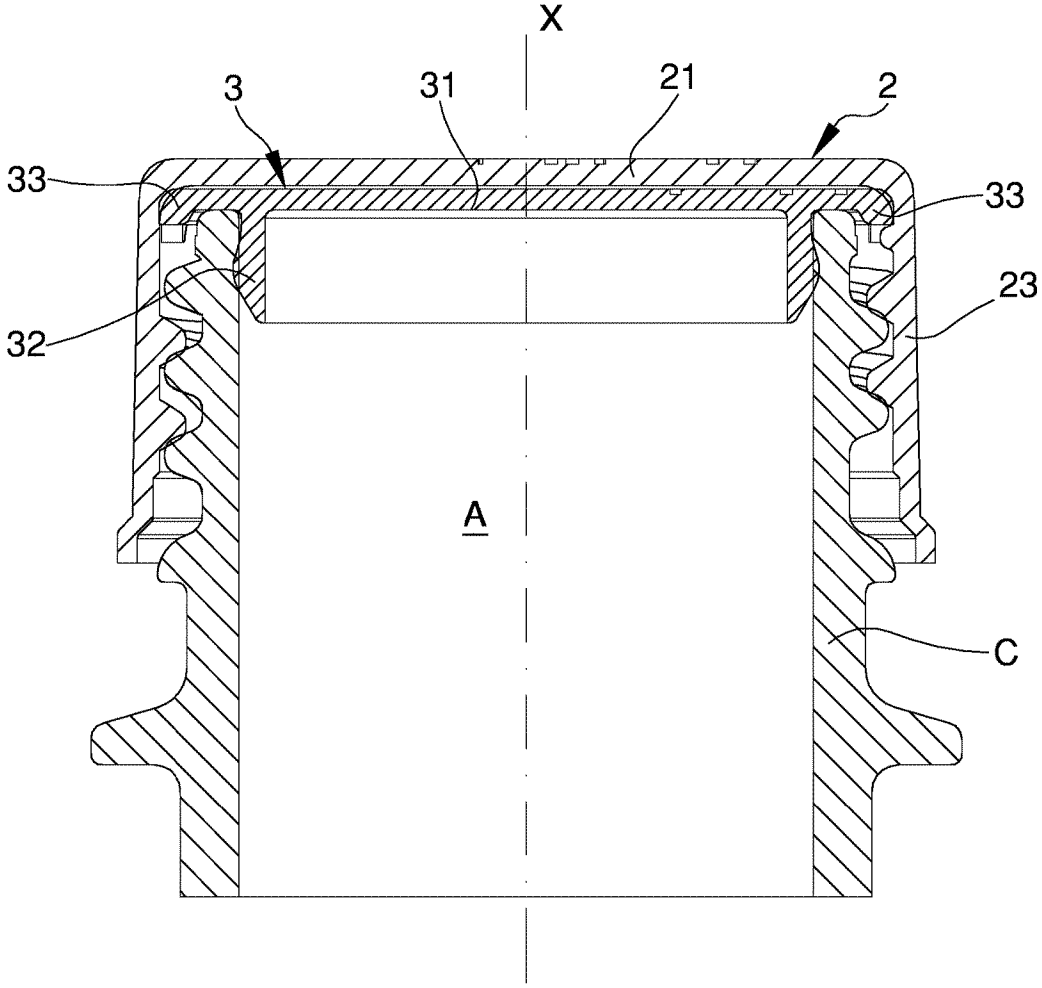
Figure 5A:
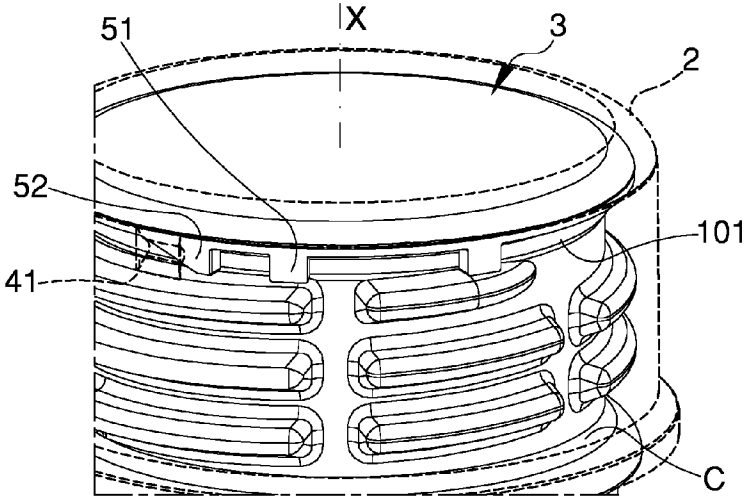
Figure 5B:
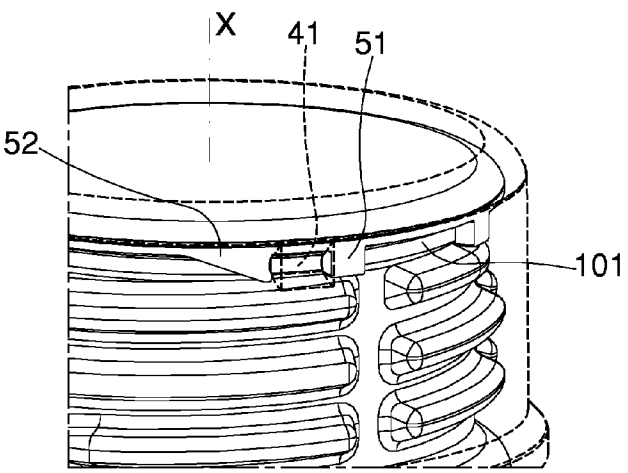
Figure 5C:
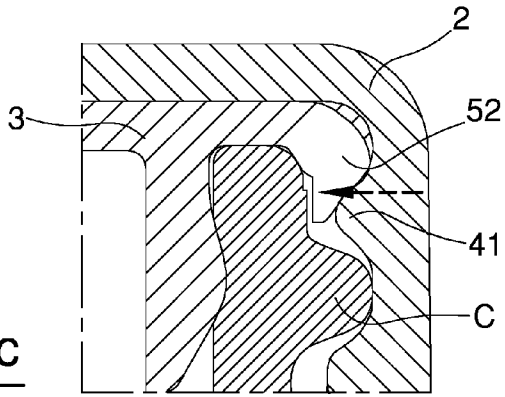
Figure 5D:
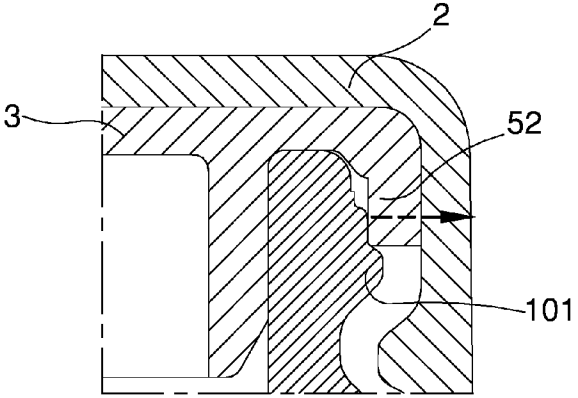

At least a first signal (71), for example writing or a symbol, is solidly constrained to the external cap (2) and visible through the top part (21) thereof. At least a second signal (72), for example more writing or another symbol, is solidly constrained to the internal element (3) and visible through the top part (21) of the external cap (2). The first and the second signal are arranged so as to align with each other in the intermediate opening position. As illustrated schematically in FIGS. 1 to 3, the first signal (71) is defined by a series of letters that are aligned, and the second signal (72) is defined by a series of other letters that are aligned. In the intermediate opening position, the various letters are aligned with each other so as to form a word, for example the word "aperto" or "open", or another word. In general, the alignment of the first and the second signal can be used as an indication signalling that the opening has taken place for the first time. As an alternative, only one of the signals (71, 72) may be present, and it could be solidly constrained to the external cap (2) or to the internal element (3), and be visible by means of a lens, or a combination of lenses, arranged on the top part (21) of the external cap (2), or it could be visible even through the top translucent portion depending on the axial distance between the internal element (3) and the top portion (21) itself.

In an alternative embodiment, the signalling means comprises an upper window (22), fashioned on the external cap (2) and that opens towards the internal element (3), or is at least transparent. A signal or symbol (73) is solidly constrained to the upper part of the internal element (3). The window (22) and the symbol (73) are arranged so as to face each other in the intermediate position. As illustrated schematically in FIGS. 9 to 11, in the intermediate unscrewing position, the symbol (73) is visible and centred in the window (22), whereas prior to reaching the intermediate unscrewing position, the symbol (73) is not visible, or is only partially visible.

In a wholly equivalent manner, the top part (21) of the external cap (2) could be transparent, and the window (22) could be replaced by an opaque portion, disposed in such a way as to cover a signal in the closed position and uncover that signal in the intermediate position, in order to indicate that the first opening has taken place. Naturally, the opaque portion could be of any shape or size.

In an alternative embodiment of the capsule, the external cap (2) is coupled to the neck (C) by means of a coupling means that provides at least for a sliding movement of the external cap (2) along the longitudinal axis (X), as shown in FIGS. 19 to 28. The relative movement between the external cap and the neck (C) may consist solely of sliding along the longitudinal axis (X) (FIGS. 26-28), or it may include a rotation movement of the external cap (2) with respect to the neck (C) about a rotation axis perpendicular to the longitudinal axis (X), located in one edge zone of the neck (C), in which the external cap (2) rotates in hinged rotation with respect to the neck (C) (FIGS. 19 to 26).

Considering an initial condition in which the capsule is applied on the neck of the container in a completely closed position, with the internal element (3) associated with the opening (A) of the container, the connecting means (4, 5) are structured so as to enable an opening, upward sliding of the external cap (2) with respect to the internal element (3), up to a given intermediate position. Essentially, during this movement, the internal element (3) remains stationary, in that it is associated with the neck (C), whereas the external cap (2) is partially lifted from the neck (C) of the container. In the intermediate position, the connecting elements (4, 5) intervene, thereby solidly constraining the external cap (2) and the internal element (3) at least with respect to the opening sliding movement along the longitudinal axis (X).

In this embodiment, the first connecting element (4) comprises at least a first bead (45) projecting inward from the lateral portion (23) of the external cap (2). The second connecting element (5) comprises a projecting edge (33), solidly constrained to the internal element (3) and structured so as to be located in contact with the first connecting element (4), that is, the first bead (45), in the intermediate position for opening or removal of the external cap (2). In the intermediate opening position, the projecting edge (33) of the internal element (3) is located in contact with the first bead (45). From this position, continuing in the movement for opening the external cap (2), that is, continuing the shifting of the external cap (2) along the longitudinal axis (X), the external cap (2) drags the internal element (3) along with it, removing it from the opening (A) of the neck (C), by virtue of the interference between the projecting edge (33) and the first bead (45). The first bead (45) and the projecting edge (33) preferably extend concentrically with the longitudinal axis (X) throughout the entire circumference. Alternatively, the first bead (45) and the projecting edge (33) may not extend throughout the entire circumference, but consist of successive tracts separated by predetermined angular pitches.

The first connecting element can be provided with a second bead (46) that projects inward from a lateral portion (23) of the external cap (2). This second bead (46) is alongside the first bead (45) so as to define a seat (47) comprised between the two beads (45, 46). As can be seen in FIGS. 19 to 28, the second bead (46) is located above the first bead (45). In addition, the second bead (46) is shaped so as to facilitate passage over the projecting edge (33) during the opening movement of the external cap (X). Essentially, during the opening movement of the external cap (2), the second bead (46) comes into contact with the projecting edge (33) before the external cap (2) reaches the intermediate opening position. Then the second bead (46) passes over the projecting edge (33), which is located in the intermediate position in contact with the first bead (45). During the process of passing over the projecting edge (33), the bead (46) produces a click that is clearly perceptible by the user. The second bead (46) is also shaped so as to prevent passage over the projecting edge (33) in the opposite direction. In this manner, it is not possible to bring the internal element (3) back to the initial configuration preceding the opening of the capsule, that is, it is not possible to extract the projecting edge (33) from the seat (47) defined between the two beads (45, 46). Preferably, the second bead (46) extends concentrically with the longitudinal axis (X) throughout the entire circumference. Alternatively, the second bead (46) may not extend throughout the entire circumference, but consist of successive tracts separated by predetermined angular pitches.

The embodiment of the connecting means comprising at least the first bead (45) and the projecting edge (33) can be advantageously utilized for the realization of a safety capsule in which the external cap (2) can rotate with respect to the neck (C) about a rotation axis (T) perpendicular to the longitudinal axis (X), in an edge zone of the neck (C), in hinged rotation.

The axis of hinged rotation (T) can be substantially defined by a zone of contact between the external cap (2) and the internal element (3), which is located in an edge zone of the internal element (3). In this case, the external cap (2) can be removed by pushing on an opposite edge zone of the external cap (2), which tends to rotate with respect to the internal element (3) about the rotation axis (T).

Figure 23:
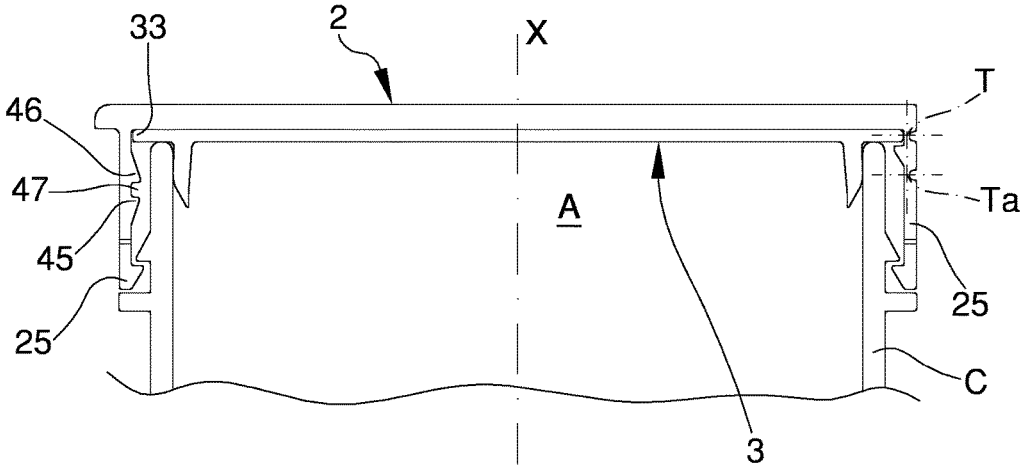
Figure 24:
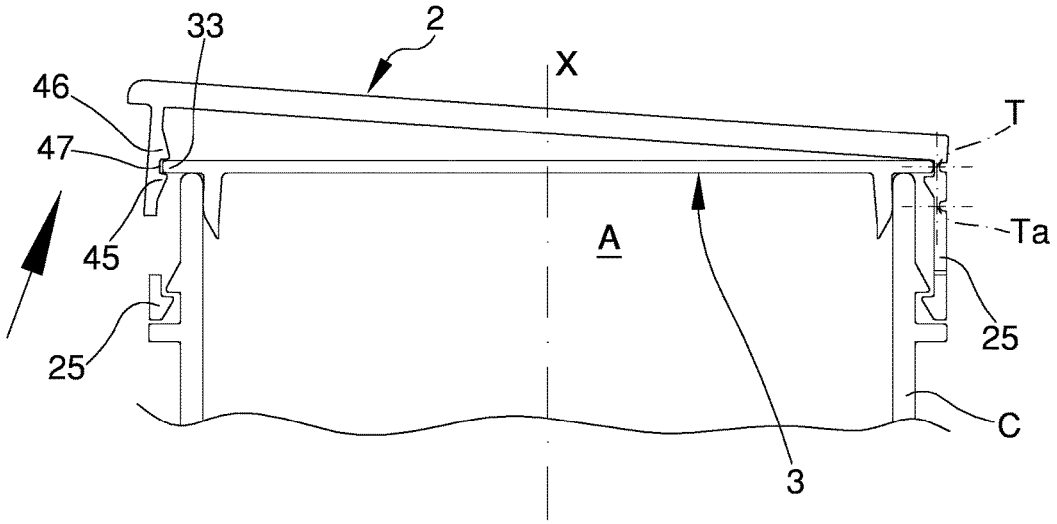
Figure 25:
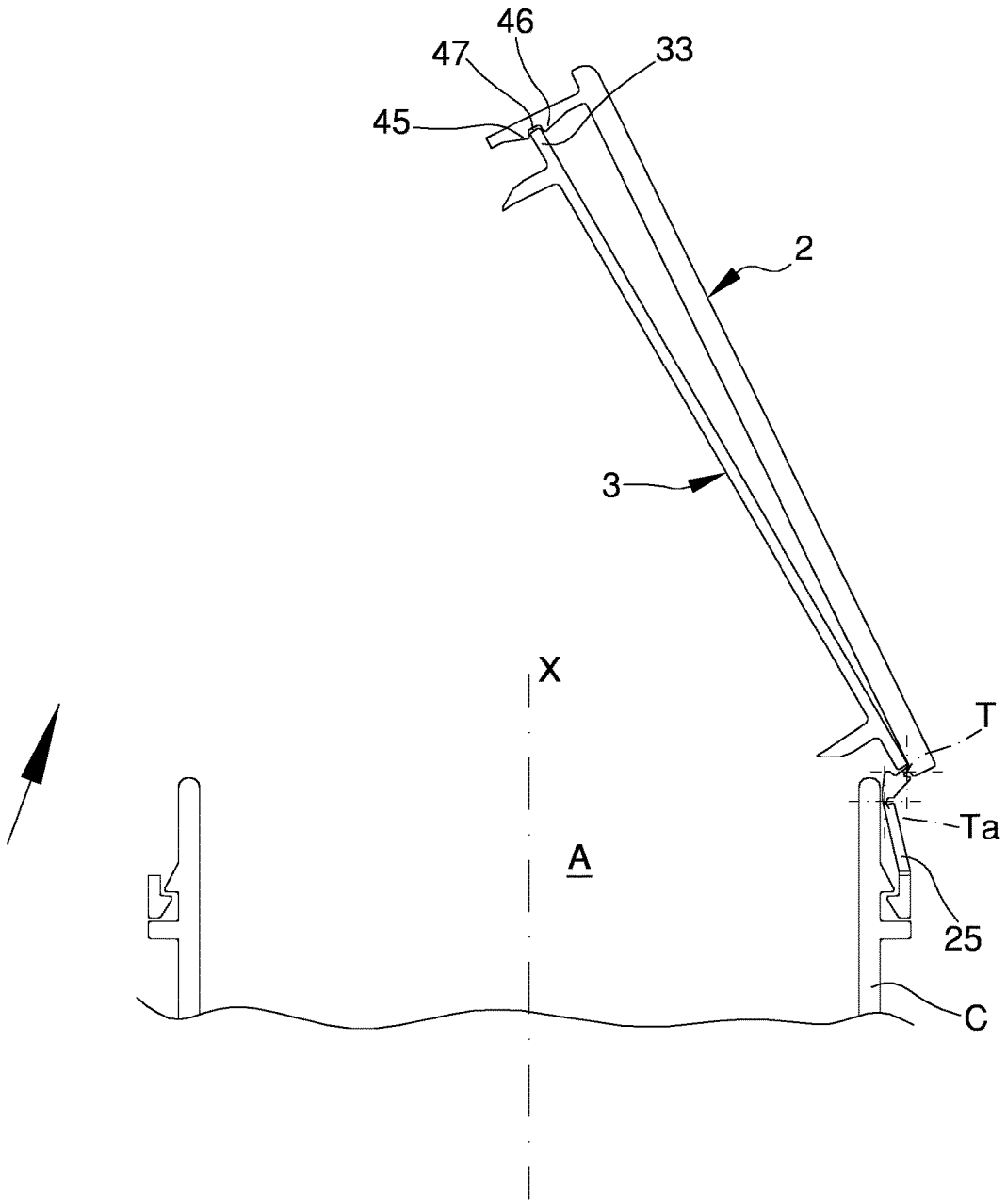
Figure 26:
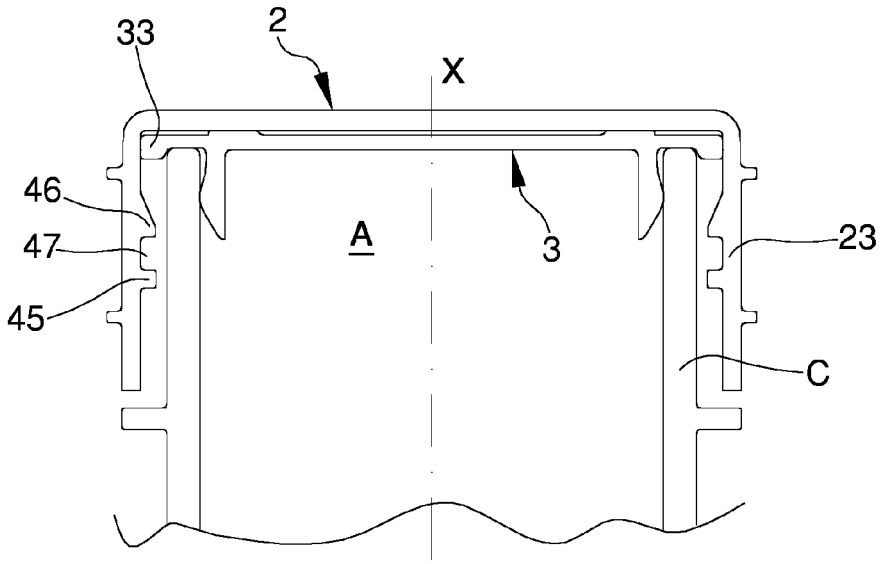
Figure 27:
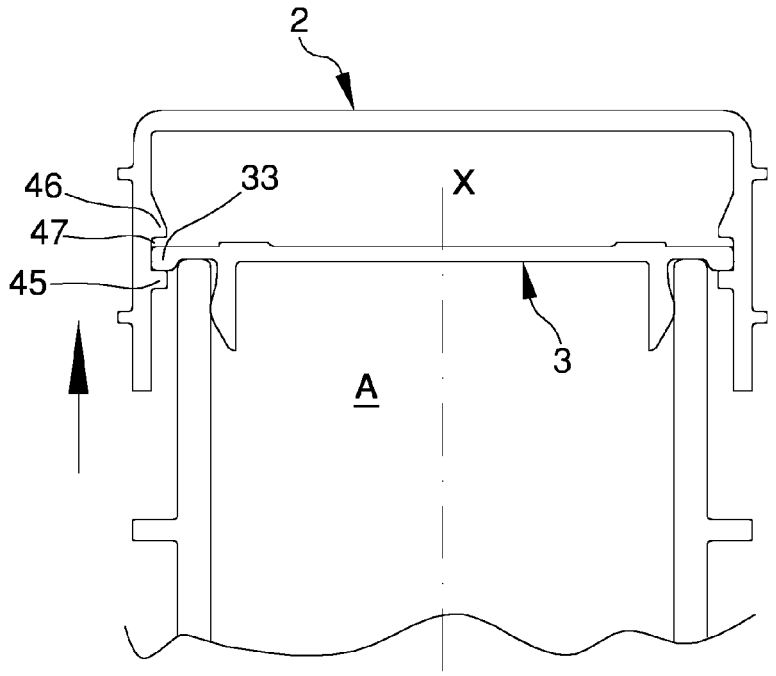
Figure 28:
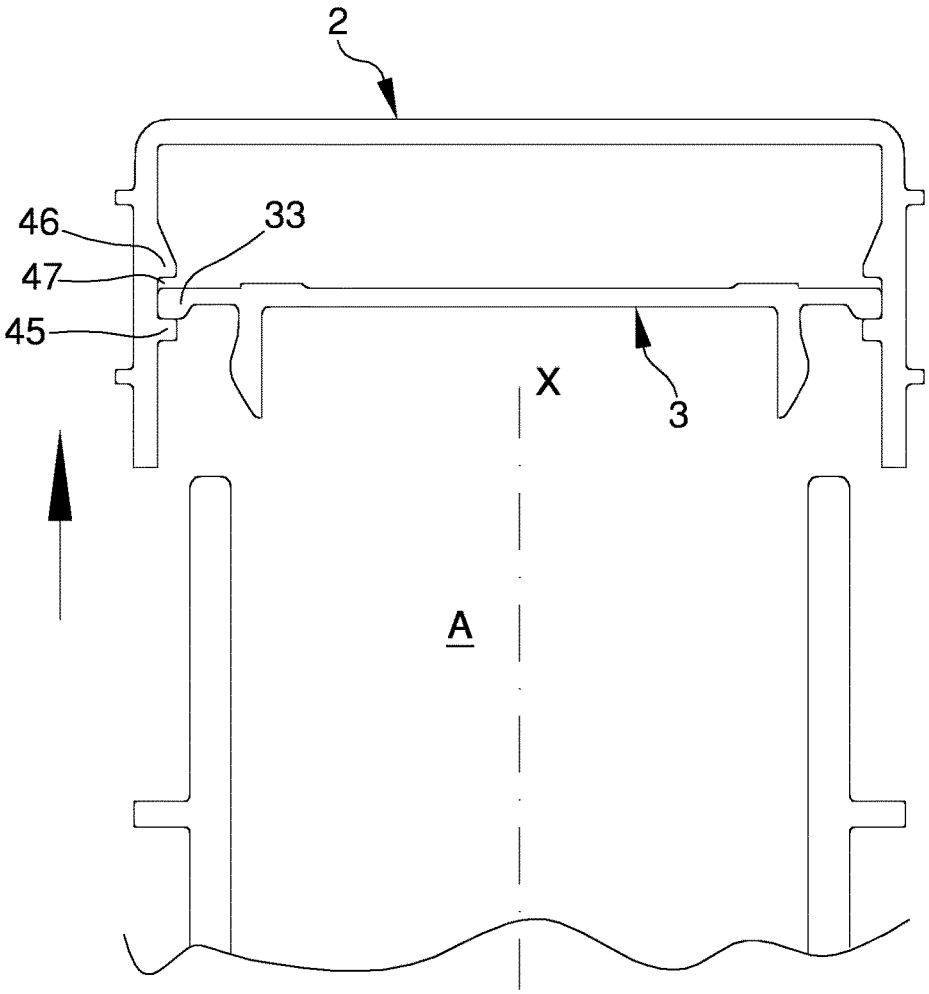

In an alternative embodiment, the external cap (2) can be hinged to a collar (25) configured to be associated with the neck (C) of the container. In this case, the rotation axis (T) is defined in the junction zone between the external cap (2) and the collar (25), which can also function as a guarantee or intactness strip. As shown in FIGS. 23-25, it is possible to provide for a first rotation axis (T) and a second rotation axis (Ta), preferably parallel to the first.

The embodiment of the connecting means comprising at least the first bead (45) and the projecting edge (33) can be advantageously utilized in combination with the coupling means with axial rotation between the external cap (2) and the neck (C) of the container. Essentially, the relative axial motion between the external cap (2) and the internal element (3) can also be obtained through relative rotation between the external cap (2) and the neck (C) of the container, for example in the presence of a threaded or cam coupling as described hereinabove.

In the above-described embodiments as well, the components of the connecting means (4,5) which were described as associated with the external cap (2) could be associated with the internal element (3) instead and, conversely, the components of the connecting means which were described as associated with the internal element (3) could be associated with the external cap (2) instead, without the operating principle of the capsule being substantially modified.

The capsule according to the present invention provides important advantages. First and foremost, it offers a clear and efficient indication of the first opening of the container to which it is applied, without any need for additional elements. The rotation and/or relative axial movement between the external cap and the internal element that takes place in the first phase of the opening rotation, until the intermediate position is reached, can be effectively used for the realization of signalling means that can be easily seen by the user. The connecting means (4, 5) can also be structured so as to block therebetween, in a substantially irreversible manner, the external cap and the internal element in the intermediate unscrewing position, so that it is not possible to alter the signal indicating that the first opening has taken place. Moreover, the capsule is simple in construction, without requiring increases in cost compared to the capsules currently available, and even proves to be more economical than several models of capsules among those currently available.

The invention claimed is:

1. A safety capsule for containers, comprising:

an external cap (2);

an internal element (3), located inside the external cap (2) and configured to be associated, in a removable manner, with an opening (A) of the container;

a coupling means, configured to enable coupling of the external cap (2) or the internal element (3) to the neck (C) of the container;

connecting means (4, 5), interposed between the external cap (2) and the internal element (3), and structured so as to leave the external cap (2) and the internal element (3) unconstrained with respect to a movement for opening or removal of the external cap (2) between a closed position and an intermediate, position, and solidly constrain the external cap (2) and the internal element (3) with respect to the movement for opening or removal of the external cap (2) between the intermediate position and an opening position;

the coupling means for coupling the external cap (2) or the internal element (3) and the neck (C) of the container provides for at least one rotation movement about a longitudinal axis (X) for the opening or the removal of the external cap (2) from the neck (C) of the container;

the connecting means (4, 5) comprise at least a first connecting element (4), solidly constrained to the external cap (2), and at least a second connecting element (5), solidly constrained to the internal element (3);

the internal element (3) comprises projecting edge (33) of a substantially annular shape and concentric with the longitudinal axis (X), for constraining the internal element to the external cap (2) with respect to movements along the longitudinal axis (X);

the first connecting element (4) comprises a small tooth (41, 42) that projects radially from an inner surface of the external cap (2) and faces the internal element (3);

the second connecting element (5) comprises a first small tooth (51) that projects downwards from an external surface of the internal element (3) and faces the external cap (2);

the small tooth (41, 42) of the first connecting element (4) projects beneath the projecting edge (33) of the internal element (3), so as to prevent the internal element from sliding off the external cap (2).

2. The capsule according to claim 1, wherein the second connecting element (5) comprises a second small tooth (52), alongside the first small tooth (51) so as to define a shaped space to receive the first connecting element (4) in the intermediate opening or removal position.

3. The capsule according to claim 2, wherein the second small tooth (52) has an external side, facing the opposite side that of the first small tooth (51), and shaped so as to facilitate passage over the small tooth (41) of the first connecting element (4) of the external cap (2) during the opening rotation of the external cap (2).

4. The capsule according to claim 2, wherein the second small tooth (52) increases in thickness nearer to the first small tooth (51).

5. The capsule according to claim 2, comprising a projecting edge (101), solidly constrained to the neck (C) of the container and structured so as to come into contact with the second small tooth (52) and to bend the second small tooth (52) outward.

6. The capsule according to claim 2, wherein the second small tooth (52) has a cavity (52C).

7. The capsule according to claim 2, wherein the second small tooth (52) has an appendage (52P) facing the first small tooth (51).

8. The capsule according to claim 2, wherein the internal element (3) comprises a recess (3A) disposed above the second small tooth (52).

9. The capsule according to claim 2, wherein the second small tooth (52) comprises a first portion (52*a*) and a second portion (52*b*); the first portion (52*a*) is structured in such a way as substantially not to interact with the small tooth (41); the second portion (52*b*) is structured to interact with the small tooth (41) and is deformable along a circumferential direction relative to the first portion (52*a*).

10. The capsule according to claim 2, wherein the first small tooth (51) and the second small tooth (52) are associated with a projecting edge (33) of the internal element (3) and project downwards.

11. The capsule according to claim 2, comprising: an abutment element (1C) that radially projects from the neck (C) of the container; a third small tooth (513), solidly constrained to the internal element (3), and structured so as to come into contact and interact with the abutment element (1C).

12. The capsule according to claim 11, wherein the external cap (2) comprises an abutment (43), which projects towards the internal element (3) from an inner surface of the external cap (2); the abutment (43) is positioned in such a way as to be superimposed on the third small tooth (513) in proximity to the intermediate position.

13. The capsule according to claim 1, comprising: a groove (53), fashioned on an upper surface (31) of the internal element (3); a projecting element (410), which projects beneath the upper portion (21) of the external cap (2) and is configured to engage with the groove (53); the groove (53) is shaped so as to produce an axial movement between the internal element (3) and an upper portion (21) of the external cap (2) during the opening rotation.

14. The capsule according to claim 13, wherein the groove (53) has a variable depth, decreasing or increasing in the direction of the opening rotation.

15. The capsule according to claim 1, wherein the connecting means comprise a first small tooth (41) that projects from an inner surface of the external cap (2) and faces the internal element (3), said first small tooth (41) being structured so as to interact with the second connecting element (5) and to retain the internal element (3) inside the external cap (2), with or without a given axial clearance.

16. The capsule according to claim 15, wherein the internal element (3) is provided with a guide section (515), which is structured so as to interact with the first small tooth (41) and to force itself between the first small tooth (41) and the upper portion (21) of the external cap (2) during a closing rotation of the external cap (2), so as to eliminate all clearance between the internal element (3) and the external cap (2) in the axial direction.

17. The capsule according to claim 1, comprising signalling means (S), structured to take on a given configuration in the intermediate position.

18. The capsule according to claim 17, wherein the external cap (2) has at least one transparent or semi-transparent top portion (21); the signalling means (S) comprises at least a first signal (71), which is solidly integral with the external cap (2) and visible through the top part (21) thereof, and at least a second signal (72), which is solidly constrained to the internal element (3) and visible through the top part (21) of the external cap (2); the first and the second signal are located so as to align with each other in the intermediate opening.

19. The capsule according to claim 17, wherein the top part (21) of the external cap (2) comprises at least one portion that is transparent and/or the conformation of which consists of a polarized or non-polarized lens or set of lenses.

20. The capsule according to claim 17, wherein the internal element (3) comprises a top portion (31) that is at least partly transparent and/or the conformation of which consists of a polarized or non-polarized lens or set of lenses.

21. The capsule according to claim 17, wherein the signalling means comprises: an upper window (22), fashioned on the external cap (2) and that opens towards the internal element (3), or is transparent, and a signal or symbol (73), solidly constrained to the upper part of the internal element (3); the window (22) and the symbol (73) are located so as to face each other in the intermediate position.

22. The capsule according to claim 1, wherein the first small tooth (51) has an external side shaped so as to facilitate passage over the small tooth (41) of the first connecting element (4) of the external cap (2) during the opening rotation of the external cap (2).

23. The capsule according to claim 1, comprising an abutment tooth (514) solidly constrained to the internal element (3) and structured so as to come into contact with the small tooth (41) of the first connecting element (4) of the external cap (2) at least during the closing rotation of the external cap (2).

* * * * *